US009279321B2

(12) United States Patent
Scott et al.

(10) Patent No.: US 9,279,321 B2
(45) Date of Patent: Mar. 8, 2016

(54) ENCAPSULATED MICROSENSORS FOR RESERVOIR INTERROGATION

(71) Applicant: Lawrence Livermore National Security, LLC, Livermore, CA (US)

(72) Inventors: Eddie Elmer Scott, Danville, CA (US); Roger D. Aines, Livermore, CA (US); Christopher M. Spadaccini, Oakland, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 396 days.

(21) Appl. No.: 13/787,665

(22) Filed: Mar. 6, 2013

(65) Prior Publication Data

US 2014/0251600 A1 Sep. 11, 2014

(51) Int. Cl.

| | |
|---|---|
| ***E21B 47/00*** | (2012.01) |
| ***E21B 47/12*** | (2012.01) |
| ***E21B 47/06*** | (2012.01) |

(52) U.S. Cl.

CPC ..... *E21B 47/06* (2013.01); *E21B 47/00* (2013.01); *E21B 47/12* (2013.01)

(58) Field of Classification Search

None

See application file for complete search history.

(56) References Cited

U.S. PATENT DOCUMENTS

| | | | | |
|---|---|---|---|---|
| 3,796,883 | A | 3/1974 | Smith et al. | |
| 3,987,850 | A | 10/1976 | Fitch | |
| 4,555,488 | A | 11/1985 | Schmitt | |
| 5,246,860 | A | 9/1993 | Hutchins et al. | |
| 5,892,147 | A | 4/1999 | Garnes et al. | |
| 6,241,028 | B1 * | 6/2001 | Bijleveld et al. | 175/40 |
| 6,324,904 | B1 * | 12/2001 | Ishikawa et al. | 73/152.03 |
| 6,443,228 | B1 * | 9/2002 | Aronstam et al. | 166/250.11 |
| 6,645,769 | B2 | 11/2003 | Tayebi et al. | |
| 6,723,683 | B2 | 4/2004 | Crossman et al. | |
| 6,780,507 | B2 | 8/2004 | Toreki et al. | |
| 7,032,662 | B2 | 4/2006 | Malone et al. | |
| 7,347,260 | B2 | 3/2008 | Ferguson et al. | |
| 7,423,931 | B2 | 9/2008 | Martin, II et al. | |
| 7,776,927 | B2 | 8/2010 | Chu et al. | |
| 2003/0056607 | A1 * | 3/2003 | Aronstam | 73/865.8 |
| 2007/0044958 | A1 * | 3/2007 | Rytlewski et al. | 166/250.01 |
| 2009/0012187 | A1 | 1/2009 | Chu et al. | |
| 2009/0131543 | A1 | 5/2009 | Weitz et al. | |
| 2010/0223988 | A1 * | 9/2010 | Crow et al. | 73/152.04 |
| 2010/0307745 | A1 | 12/2010 | Lafitte et al. | |
| 2013/0213490 | A1 * | 8/2013 | Bhatnagar | E21B 37/06 137/13 |

FOREIGN PATENT DOCUMENTS

WO 2007132137 A1 11/2007

OTHER PUBLICATIONS

McDaniel et al., "A New Environmentally Acceptable Technique for Determination of Propped Fracture Height and Width," Society of Petroleum Engineers, 2007, pp. 1-11.

* cited by examiner

*Primary Examiner* — Giovanna C Wright

(74) *Attorney, Agent, or Firm* — Zilka-Kotab, PC

(57) ABSTRACT

In one general embodiment, a system includes at least one microsensor configured to detect one or more conditions of a fluidic medium of a reservoir; and a receptacle, wherein the receptacle encapsulates the at least one microsensor. In another general embodiment, a method include injecting the encapsulated at least one microsensor as recited above into a fluidic medium of a reservoir; and detecting one or more conditions of the fluidic medium of the reservoir.

35 Claims, 10 Drawing Sheets

ENCAPSULATED MICROSENSORS FOR RESERVOIR INTERROGATION

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to reservoir interrogation and more particularly to encapsulated microsensors for reservoir interrogation.

BACKGROUND

Traces have typically been used to obtain information about a reservoir and/or about what is taking place therein. In particular, tracers may be used to label fluids that are injected into a specified reservoir in order to track fluid movement and fluid velocities, as well as monitor chemical changes of the injected fluid. U.S. Pat. No. 5,246,860, for example, teaches tracer chemicals for use in monitoring subterranean fluids, e.g. geothermal brines) and is herein incorporated by reference in its entirety.

U.S. Pat. No. 4,555,488 provides another method for utilizing tracer chemicals to determine flow patterns in subterranean petroleum and mineral containing formations using organonitrogen tracers, and is herein incorporated by reference in its entirety. In recovery of petroleum or minerals from subterranean formations, especially by chemical flooding, it is desirable to know the flow patterns of the formation prior to injection of chemicals. Tracers are used in such reservoir engineering. The tracer is generally water soluble and inert to the solids and liquids present in the formation (e.g. it does not get absorbed onto the rocks; it does not partition into any oil phase which may be present; and it does not interact with the organics and minerals present in the formations).

Another common use for tracers is with regard to hydraulic fracturing. Hydraulic fracturing is a well-established technique for stimulating production from a hydrocarbon reservoir. Typically a thickened, viscous fracturing fluid is pumped into the reservoir formation through a wellbore and fractures the formation. Thickened fluid is then also used to carry a particulate proppant into the fracture. The fracturing fluid is subsequently pumped out and hydrocarbon production is resumed. As the fracturing fluid encounters the porous reservoir formation a filtercake of solids from the fracturing fluid builds up on the surface of the rock constituting the formation. After fracturing has taken place a breaker (which is usually an oxidizing agent, an acid or an enzyme) may be introduced to break down this filter cake and/or to reduce the viscosity of the fluid in the fracture and allow it to be pumped out more effectively. Tracers may be used in connection with this hydraulic fracturing procedure, mainly to provide information on the location and orientation of the fracture, as described in U.S. Pat. No. 3,987,850. U.S. Pat. No. 3,796,883 describes a further use of radioactive tracers to monitor the functioning of a well gravel pack.

Additionally, tracers may be introduced into the reservoir using various known methods. For instance, tracers may be associated with a carrier material (e.g. particles) from which the tracer is released after the carrier material is placed in a subterranean reservoir and/or exposed to the contents therein. U.S. Pat. No. 6,723,683 describes using starch particles as a carrier for a variety of oilfield chemicals including tracers.

U.S. Pat. Nos. 7,032,662 and 7,347,260 also describe the association of a tracer substance with a carrier. U.S. Pat. Pub. No. 2010/0307745 further describes the use of encapsulated tracers and is herein incorporated by reference in its entirety.

Moreover, U.S. Pat. No. 5,892,147 discloses a procedure where, during the manufacture of a well, a plurality of different tracer substances are placed at respective locations along the length of a well penetrating a reservoir prior to completion of the well. When the manufacture of the well is completed and production commences, the individual tracers may be monitored in order to calculate the proportions of oil or gas being flowing into the well from the reservoir. U.S. Pat. No. 6,645,769 also provides that multiple tracers (associated with carrier particles) should be located at respective zones of a reservoir and/or injection well during completion of the injection well. Specifically, this patent describes dividing regions around wells in the reservoir into a number of zones/sections and immobilizing tracers on a filter, a casing or other such construction surrounding the injection well in different zones/sections.

Typically, tracers comprise distinctive chemicals, which may be detected in high dilution, such as fluorocarbons, dyes or fluorescers. Genetically coded material has also been proposed as a possible tracer (e.g. WO2007/132137 provides a method for detection of biological tags). However, modern tracers generally comprise radioactive isotopes (e.g. Society of Petroleum Engineers paper SPE 109,969 discloses the use of materials which can be activated to become short lived radioactive isotopes). Such radioactive isotopes may include potassium iodide, ammonium thiocyanate, dichromate, etc. Unfortunately radioactive isotopes are expensive and require special handling by licensed personnel because of the danger posed to personnel and the environment. Another drawback to using radioactive isotopes is the alteration by the radioactive materials of the natural isotope ratio indigenous to the reservoir, thereby interfering with scientific analysis of the reservoir fluid characteristics. The half-life of radioactive tracers also tends to be either too long or too short for practical use. In addition, certain radioactive isotopes, such as potassium iodide, may be limited to wet analyses type detection methods.

Accordingly, despite the importance of tracers in tracking the movement and/or characteristics of fluids in reservoirs, very few suitable tracers are presently available. Furthermore, of those that are available, little is known about their stabilities or behavior in specific environmental conditions.

SUMMARY

A system according to one embodiment includes at least one microsensor configured to detect one or more conditions of a fluidic medium of a reservoir; and a receptacle, wherein the receptacle encapsulates the at least one microsensor.

A method according to one embodiment include injecting the encapsulated at least one microsensor as recited above into a fluidic medium of a reservoir; and detecting one or more conditions of the fluidic medium of the reservoir.

Other aspects and embodiments of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, reference should be made to the following detailed description read in conjunction with the accompanying drawings.

DETAILED DESCRIPTION

Figure 1:
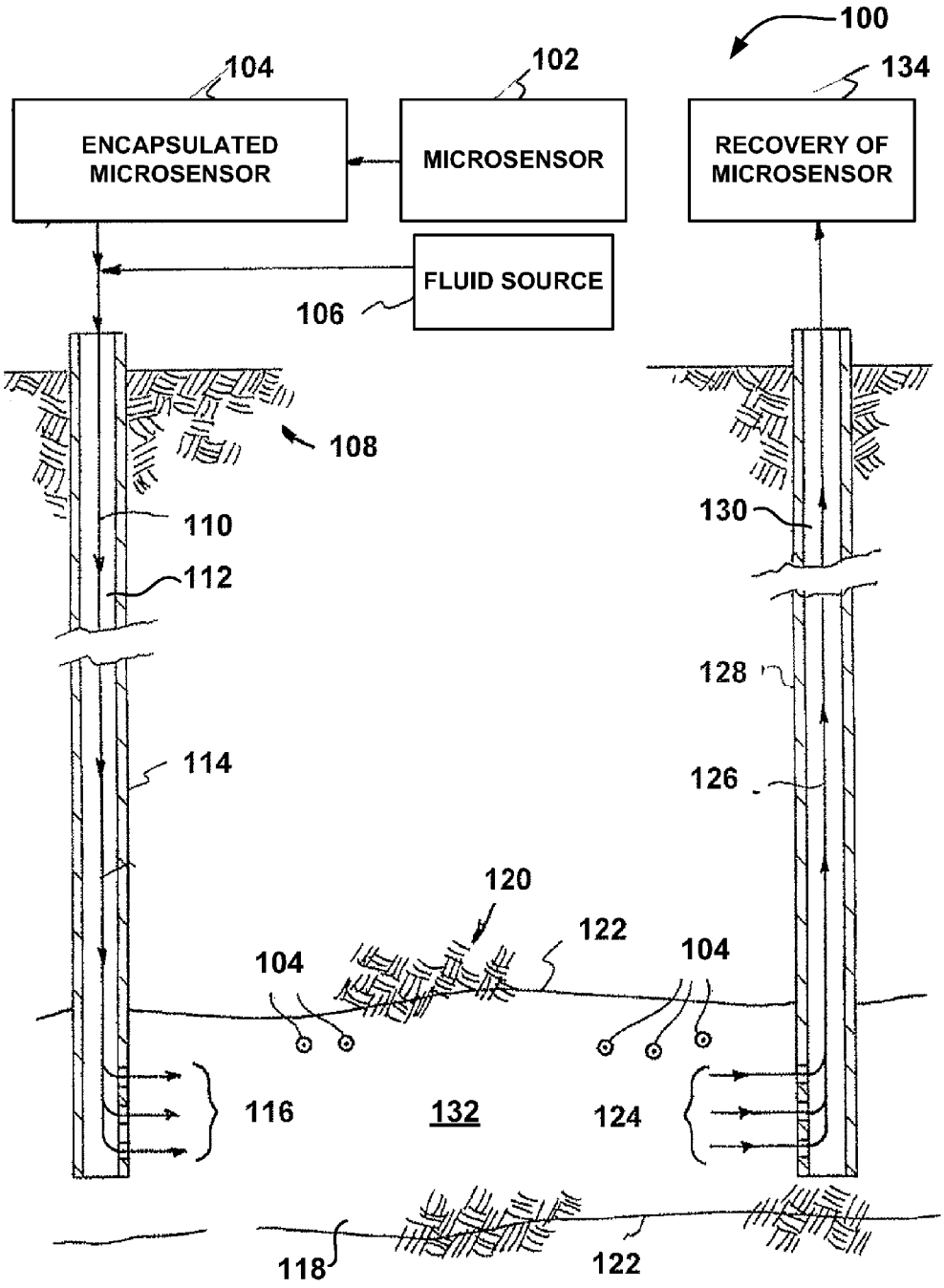
FIG. 1 illustrates a schematic diagram of a system for performing reservoir interrogation, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of encapsulated microsensors for reservoir interrogation and/or related systems and methods.

In one general embodiment, a system includes at least one microsensor configured to detect one or more conditions of a fluidic medium of a reservoir; and a receptacle, wherein the receptacle encapsulates the at least one microsensor.

In another general embodiment, a method include injecting the encapsulated at least one microsensor as recited above into a fluidic medium of a reservoir; and detecting one or more conditions of the fluidic medium of the reservoir.

Embodiments described herein provide systems and methods for detecting, recording, transmitting, analyzing, etc. information regarding conditions present in a fluidic medium of a reservoir. These conditions of the fluidic medium may include, but are not limited to, flow paths, a temperature, a pressure, a pH, a chemical composition, types of fluidic media at specific depths, a sweep efficiency, a velocity, etc. The information concerning the conditions of the fluidic medium, may, in turn, provide information regarding the characteristics of the reservoir itself, such as a storage volume, a size, a topography/shape, the degree of interconnectedness of pathways/channels within the reservoir, the degree of interconnectedness with other reservoirs, etc. Obtaining and/or analyzing the information regarding the conditions in a fluidic medium, as well as the characteristics of the reservoir itself, may ultimately enable better extraction and/or management of the fluidic medium in the reservoir.

In preferred embodiments, microsensors, which may or may not be encapsulated in a receptacle, may detect, record and, in certain approaches, even transmit, the conditions present in a fluidic medium. Fluidic media whose movements are capable of being monitored by these microsensors include, but are not limited to, geothermal brine, crude oil, ground water, hazardous waste, and injected fluids used in enhanced oil recovery operations, e.g., steam floods, carbon dioxide floods, caustic floods, micellar-polymer floods, and straight polymer floods.

As used herein the term geothermal refers to or relates to the internal heat of the earth.

As also used herein, hydraulic fracturing, hydrofracking, fracking, and hydroshearing refer to processes by which open fissures in subterranean formation are forced open.

As additionally used herein, a microsensor refers to a device that detects information about a specific variable. For example, the variable may include one or more conditions of a fluidic medium, of a reservoir.

As used herein, the term "fluid" and "fluid medium" generally refers to a substance/medium that tends to flow and conform to the outlines of its container, e.g. a liquid, a gas, a viscoelastic fluid, etc.

As also used herein, the term "about" generally refers to plus or minus 10% of a reference value.

Referring now to FIG. 1, a schematic diagram of a system 100 for performing reservoir interrogation, e.g. for detecting and/or analyzing one or more conditions of a fluidic medium, of a reservoir is shown according to one exemplary embodiment. As an option, system 100 may be implemented in conjunction with features from any other embodiment listed herein, such as those described with reference to the other FIGS. Of course, the system 100 and others presented herein may be used in various applications and/or in permutations, which may or may not be specifically described in the illustrative embodiments listed herein. Further, the system 100 presented herein may be used in any desired environment.

As shown in FIG. 1, one or more microsensors 102 are encapsulated into a receptacle, thereby yielding an encapsulated microsensor 104. It is important to note that the receptacle may include a plurality of microsensors 102 in some approaches. In additional approaches, the system 100 may include a plurality of receptacles, each of which may encapsulate one or more microsensors 102. Further, where the system 100 may include a plurality of receptacles, the receptacles may comprise different materials and/or have different wall thicknesses from one another.

In one embodiment the microsensor 102 may comprise an microelectrical sensor, a micromechanical sensor, a microchemical sensor, a microoptical sensor, a microchip, or other such suitable sensor as would be understood by one having skill in the art upon reading the present disclosure. Further, in embodiments where a plurality of microsensors are encapsulated in a receptacle, the plurality of microsensors may comprise sensors (e.g. microelectrical sensors, micromechanical sensors, microchemical sensors, microoptical sensors, microchips) that are the same, different, or any combination thereof, from one another.

With continued reference to FIG. 1, the encapsulated microsensor 104 is fed into an injection well 112 using fluid from a fluid source 106. The injection well 112 comprises a casing 114. Additionally, the injection well 112 extends into the earth 108 and into a formation 120, where the formation 120 is disposed in the earth 108. The injection well 112 also extends into a reservoir 118, where the reservoir 118 is disposed in the formation 120 and is defined by a boundary 122.

As shown in FIG. 1, the encapsulated microsensor 104 subsequently travels down the injection well 112, as illustrated by arrows 110. The encapsulated microsensor 104 continues into the reservoir 118, as indicated by arrows 116.

In some approaches, the receptacle comprises a porous material that facilitates communication/contact between a fluidic medium 132 of the reservoir 118 and the microsensor 102. Accordingly, in numerous approaches, the microsensor 102 may be in direct physical contact with the fluidic medium 132 of the reservoir when the encapsulated microsensor 104 is disposed in the fluidic medium 132. The fluidic medium 132 of the reservoir 118 may comprise one or more gases, one of more fluids, fluids adapted for/used in oil recovery operations (e.g. caustic floods, steam floods, carbon dioxide floods, polymer floods, micellar-polymer floods, etc.), geothermal brine, crude oil, ground water, hazardous waste, etc.

Again referring to FIG. 1, the microsensor 102 may be configured to detect and/or record one or more conditions of the fluidic medium 132 in the reservoir 118. For instance, the microsensor 102 may be configured to detect and/or record one or more conditions of the fluidic medium 132 in the reservoir when at least a portion of the fluidic medium 132 passes through the receptacle such that the microsensor 102 comes into contact with the fluidic medium 132.

In various approaches, the one or more conditions of the fluidic medium 132 may include, but is not limited to, a flow path(s), a temperature, a pressure, a density, a sweep efficiency, a fluid conductivity, a thermal conductivity, a chemical composition, a pH, a turbidity, types of fluids and/or analytes at given depths, a velocity, and other such conditions as would be understood by one having skill in the art upon reading the present disclosure.

As shown in FIG. 1, the encapsulated microsensor 104 is then drawn into a recovery well 130, as indicated by arrows 124. The recovery well 130 is lined by a casing 128 and extends into the earth 108, into the formation 120, and into the reservoir 118.

Next, the encapsulated microsensor 104 travels up the recovery well 130 toward an upper surface of the earth 108, as indicated by arrows 126. In some approaches, the system 100 may include a mechanism 134 configured to retrieve/recover the encapsulated microsensor 104 from the recovery well 130.

In some approaches, the system 100 may include a mechanism for obtaining/receiving the one or more conditions of the fluidic medium 132 detected/recorded by the microsensor 102. For instance, in various approaches, the microsensor 102 may be configured to transmit the detected one of more conditions of the fluidic medium. Accordingly, the system 100 may include a mechanism (e.g. a receiver device) configured to receive the transmitted conditions of the fluidic medium.

In numerous approaches, the system 100 may also include a mechanism configured to analyze the detected one or more conditions of the fluidic medium 132. Analysis of the detected one or more conditions of the fluidic medium may provide information relating to one or more characteristics of the reservoir 118 itself. For example, the one or more characteristics of the reservoir 118 may include, but is not limited to, a storage volume, a temperature, a size of the reservoir, a topography/shape of the reservoir, a presence of one or more pathways/channels, an interconnectedness of one or more independent channels/pathways within the reservoir, etc.

In even more approaches, the receptacle encapsulating the microsensor 102 may be configured to at least partially dissolve or degrade when at least one of the detected conditions is about equal to, less than or greater than a predetermined value. The predetermined values may be set by a user, by historic operating conditions, referenced in a table or database, etc. For example, in one embodiment, the receptacle may be configured to at least partially dissolve or degrade when the microsensor 102 detects (or the receptacle itself detects) that a temperature of the fluidic medium 132 exceeds a predetermined temperature. In another embodiment, the receptacle encapsulating the microsensor 102 may be configured to at least partially dissolve or degrade when at least one of the detected conditions is about equal to, less than or greater than a predetermined value for a predetermined length of time. In yet another embodiment, the microsensor 102 may be configured to at least partially dissolve or degrade after passage of a predetermined length of time. The predetermined length of time may be set by a user, may be referenced in a table or database, etc.

In cases where the receptacle at least partially degrades or dissolves, the microsensor 102 may be drawn into and travel up the recovery well 130. In addition, the system 100 may include a mechanism to retrieve/recover the microsensor 102 from the recovery well 130.

According to one embodiment, the system 100 may include a first receptacle encapsulating a first microsensor, where the first receptacle may be configured to release the first microsensor (e.g. be configured to at least partially dissolve/degrade), when a first condition (or a first set of conditions) of the fluidic medium is at least equal to, less than or greater than a predetermined value. The system 100 may also include a second receptacle encapsulating a second microsensor, where the second receptacle may be configured to release the second microsensor (e.g. be configured to at least partially dissolve/degrade), when a second condition (or a second set of conditions) of the fluidic medium is about equal to, less than, or greater than a predetermined value. In some approaches, the first and second conditions (or the first set and second set of conditions) are different from one another. For example, the first receptacle may dissolve/degrade, thereby releasing the first microsensor(s) when the fluidic medium exceeds a predetermined temperature value, and the second receptacle may dissolve/degrade, thereby releasing the second microsensor(s) when the fluidic medium exceeds a predetermined pressure value. These predetermined values corresponding to one or more conditions of the fluidic medium may be set by a user, referenced in a table or database, based on historic operating conditions, etc. Moreover, the system 100 may include a plurality of receptacles each of which encapsulate one or more microsensors, and each of which may be configured to dissolve/degrade when different/distinct conditions of the fluidic medium are about equal to, less than or greater than their respective predetermined values.

According to another embodiment, the first and second receptacles described directly above may be configured to at least partially dissolve/degrade (e.g. be configured to release their respective microsensor(s)) when the same condition (or the same set of conditions) is about equal to, less than or greater than a predetermined value (or predetermined values). However, in some approaches, e.g. where the first and second receptacles are comprised of different materials, different sizes, shapes, and/or different wall thicknesses, the first and second receptacles may be configured to at least partially dissolve/degrade at different times. For example, in some approaches, the first receptacle may be configured to dissolve/degrade when the first receptacle (or its encapsulated microsensor(s)) is immediately exposed to a temperature of the fluidic medium that is about equal to, less than or greater than a predetermined temperature value. Conversely, the second receptacle may be configured to dissolve/degrade only after prolonged exposure to the same release trigger (e.g. the temperature of the fluidic medium that is about equal to, less than or greater than the predetermined temperature value). Accordingly, in such approaches, the first, second (third, fourth, etc.) receptacles, as well as their respective encapsulated microsensor(s), may be specifically configured to interrogate specific and/or desired conditions of the fluidic medium.

Figure 2A:
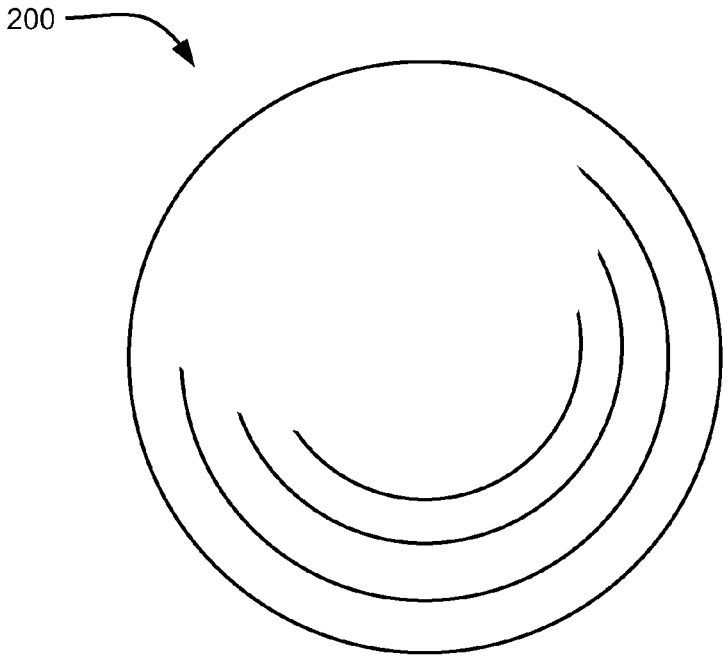
FIGS. 2A-2B illustrate schematic diagrams of an encapsulated microsensor, according to one embodiment.
Figure 2B:
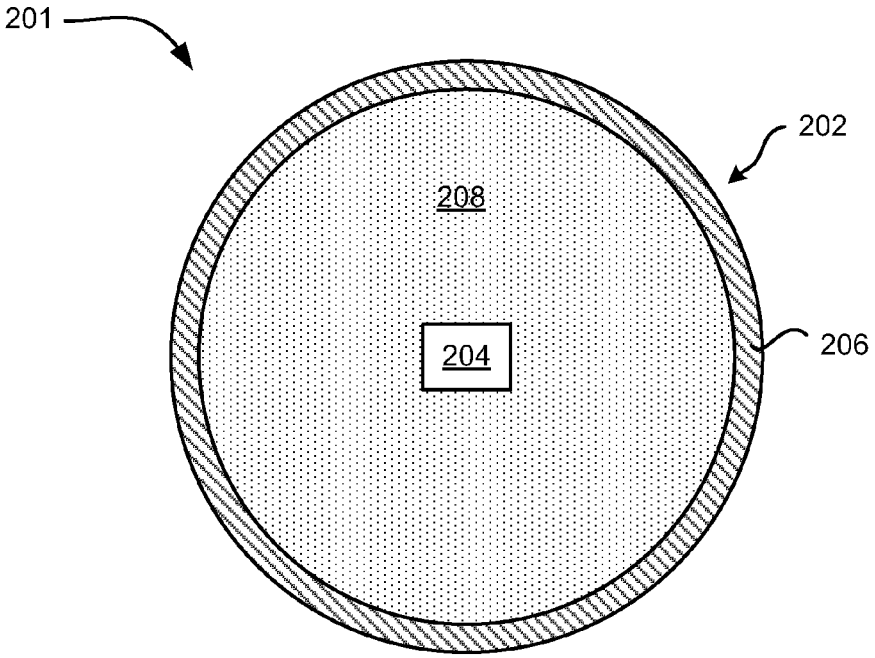

Now referring to FIGS. 2A-2B, schematic diagrams of a receptacle and an encapsulated microsensor (200 and 201, respectively) are shown according to illustrative embodiments. As an option, the receptacle 200 and encapsulated microsensor 201 may be implemented in conjunction with features from any other embodiment listed herein, such as those described with reference to the other FIGS. Of course, the receptacle 200 and encapsulated microsensor 201 and others presented herein may be used in various applications and/or in permutations, which may or may not be specifically described in the illustrative embodiments listed herein. Further, the receptacle 200 and encapsulated microsensor 201 presented herein may be used in any desired environment.

FIG. 2A provides an exemplary illustration of a receptacle 200, according to one approach. As shown, the one or more shells of the receptacle may comprise one or more concentric shells. Further, as shown, the one or shells may be spherical in shape. It is important to note, however, that the receptacle may also comprises one or more shells that have an elliptical shape, a rectangular shape, or other such suitable shape.

As show in FIG. 2B, a microsensor 204 is disposed in, e.g. encapsulated in, a receptacle 202. In exemplary approaches, the microsensor 204 may be configured to detect one or more conditions of a fluidic medium of a reservoir, where the one or more conditions of the fluidic medium may include, but is not limited to, a flow path(s), a temperature, a pressure, a density, a sweep efficiency, a fluid conductivity, a thermal conductivity, a chemical composition, a pH, a turbidity, types of fluids and/or analytes at given depths, a velocity, etc. In some approaches a plurality of microsensors may be encapsulated in the receptacle 202. In such approaches involving a plurality of microsensors encapsulated in the receptacle 202, the plurality of microsensors may each be configured to detect the same or different conditions from one another.

As also shown in FIG. 2B, the receptacle 202 includes a shell 206 that may comprise one or more materials and that has a desired thickness to facilitate reservoir interrogation (e.g. the detection and/or analysis of conditions of a fluidic medium of the reservoir). In one approach the shell 206 may comprise a porous material to facilitate communication/contact between the microsensor 204 and a fluidic medium of a reservoir. For example, the porous material of the shell 206 may be configured to allow at least a portion of a fluidic medium of a reservoir to pass through the receptacle 202 and come into direct physical contact with the microsensor 204.

According to one embodiment, the shell 206 of the receptacle 202 may comprise a polymer material. In some approaches, the polymer material may be capable of withstanding temperatures of about 100 to about 2000° C. In additional approaches, the polymer material may be capable of withstanding small volumetric changes due to absorption and/or desorption of a fluid (e.g. water).

In some embodiments, the shell 206 may comprise polymerizable or cross-linkable material, including but not limited to a silicone, a siloxane (e.g. polydimethylsiloxane, etc.), a polymer (e.g. polyamide, polyacrylate, polyurethane, etc.), an adhesive (e.g. epoxies, mercapto-esters, etc.) and other suitable material as would be recognized by one having skill in the art upon reading the present disclosure. In more embodiments, the shell 206 may comprise other suitable materials configured to function, e.g. facilitate reservoir interrogation, under one or more environmental conditions. These environmental conditions may include, but are not limited to, a temperature of the fluidic medium of the reservoir, a pressure of the fluidic medium of the reservoir, a chemical composition of the fluidic medium of the reservoir, a pH of the fluidic medium of the reservoir, a density of the fluidic medium of the reservoir and other such environmental conditions as would be understood by one having skill in the art upon reading the present disclosure.

In more embodiments, the shell 206 may be configured to remain intact when exposed to a fluidic medium of the reservoir. Accordingly, the encapsulated microsensor 200, after being injected into a fluidic medium of a reservoir via an injection well (e.g. 112 of FIG. 1), may be subsequently retrieved/recovered with the shell 206 of the receptacle 202 still intact (e.g. the microsensor 204 may still remain encapsulated in the receptacle 202).

In other embodiments, the shell 206 may be configured to at least partially dissolve or degrade when the shell 206 is exposed to one or more conditions of the fluidic medium of the reservoir. For example, the shell 206 may be configured to at least partially dissolve or degrade when at least one of the one or more conditions of the fluidic medium is about equal to, less than or greater than a predetermined value. The one or more conditions of the fluidic medium may include, but is not limited to, a temperature, a pressure, a chemical composition, a pH, a velocity, a thermal and/or electrical and/or fluid conductivity, etc. The shell 206 may also be configured to at least partially dissolve or degrade when at least one of the one or more conditions of the fluidic medium is about equal to, less than or greater than a predetermined value for a predetermined length of time. Additionally, the shell 206 may be configured to at least partially dissolve or degrade after a predetermined length of time. The predetermined value and/or predetermined length of time may be specified by a user, referenced in a table or database, etc.

According to another embodiment, a material 208 may be disposed/encapsulated in the shell 206. The material 208 may be a suitable and/or known material configured to cushion the microsensor 204, which is also encapsulated within the shell 206. The material 208 may also provide advantages and/or be an integral part of the manufacture of the encapsulated microsensor 200. In some approaches, the material 208 may be a tracer.

In numerous approaches, the receptacle 202 may have a diameter in a range between about 1 μm to about 1 mm. In additional approaches, the diameter of the receptacle 202 may be small enough or of a suitable size to allow for efficient mass transfer yet be large enough or of a suitable size to allow for ease of handling. In further approaches, the receptacle 202 may have a wall thickness (e.g. the thickness of the outer shell 206) in a range from between about 1 to about 25 μm.

In various approaches, known receptacle assembly process/techniques may be implement to produce/manufacture the receptacle 202. Use of these known assembly processes/techniques may allow control over, or manipulation of, a size and polydispersity of the receptacle 202, a thickness of the shell 206, etc.

Systems and methods for producing receptacles, e.g. microcapsules, multiple emulsions, etc., are described in U.S. Pat. No. 7,776,927 and in U.S. Pat. Pub. Nos. 2009/0012187 and 2009/0131543, which are herein incorporated by reference. For example, said references generally relate to and disclose emulsions and the production thereof, as well as microfluidic systems for producing multiple emulsions. A multiple emulsion generally refers to larger droplets that contain one or more smaller droplets therein, where, in some cases, some of the smaller droplets may contain even smaller droplets therein, etc. Multiple emulsions may be useful for encapsulating species such as pharmaceutical agents, cells, chemicals, or the like. In some cases, one or more of the droplets (e.g., an inner droplet and/or an outer droplet) can change form, for instance, to become solidified to form a microcapsule, a liposome, a polymerosome, or a colloidosome. Furthermore, emulsions, including multiple emulsions, may be formed with precise, or near precise repeatability and may be tailored to include one, two, three, or more inner droplets within a single outer droplet (in any desired nesting arrangement). Additionally, in other disclosed approaches, one or more droplets may be controllably released from a surrounding droplet.

An exemplary method for producing/manufacturing a microcapsule or receptacle, such as receptacle 202, is provided in detail below according to one embodiment. This method may provide benefits in fabrication, manufacturability, survivability and robustness of the resulting microcapsule or receptacle.

According to this embodiment, a round injection tube may be provided, where the injection tube may taper to an opening. The diameter of the opening ("opening diameter") of the injection tube may be about 1 to about 1,000 micrometers (μm) in some approaches. The injection tube may then be inserted and secured into a square outer tube. The outer diameter ("OD") of the injection tube, e.g. about 0.8 to about 1.5 millimeters (mm), may be slightly smaller than the inner diameter ("ID") of the outer tube. In various approaches, the injection tube may be centered in the outer tube.

A round collection tube may be inserted in the outer tube to within about 100 to about 800 μm of the opening diameter of the injection tube and secured in place. An opening diameter of the collection tube may be about 2 to about 10 times larger than the opening diameter of the injection tube. Additionally, the OD of the collection tube may be about equal to the OD of the injection tube.

An inner (core) fluid may be delivered to and disposed in the injection tube; a middle (shell) fluid may be delivered to and disposed in the interstitial region between the injection tube and the outer tube; and an outer (collection) fluid may be delivered to and disposed in the collection tube and the interstitial region between the collection tube and the outer tube. Each fluid may be delivered via liquid-tight connections (e.g. connections which prevent leakage of the enclosed liquid) and may be delivered with controlled volumetric flow rates. For instance, in some approaches, the volumetric flow rate for the middle and outer fluids may be about 10 to about 1000 times larger than the volumetric flow rate of the inner fluid. In numerous approaches, the volumetric flow rates of the middle and outer fluids may be about 100 to about 1000 μl/h.

The inner fluid, which may have a viscosity of about 1 to about 1000 (cP) in some approaches, flows in the injection tube in a direction toward the opening diameter. The opening diameter of the tapered injection tube effectively serves as a droplet-forming nozzle. Accordingly, as the inner fluid flows along the tapered injection tube and into the opening diameter, a droplet ("inner fluidic droplet") is formed. The formed inner fluidic droplet may then be released from opening diameter of the injecting tube and become subsequently encapsulated/encased/contained in the middle fluid, which may have a viscosity that is about 10 to about 100 times greater than the viscosity of the inner fluid in various approaches. Thus, the inner fluidic droplet may become encased in a middle fluidic droplet thereby forming an encapsulated inner fluidic droplet (the "resulting receptacle") that has a core (the inner fluidic droplet) surrounded by an outer shell (e.g. comprised of the middle fluid).

The outer fluid, which may have a viscosity that is about 10 to about 100 times greater than the viscosity of the inner fluid, may flow, e.g. hydrodynamically flow, in the outer tube to focus the resulting receptacle toward the active zone and/or aid in forming the multiple emulsion near the active zone, e.g. the region between the opening diameter of the injection tube up to several millimeters within the collection tube. Further, the outer fluid may carry the resultant receptacle into a collection container. The resultant receptacle may be formed with a diameter in a range from about 10 to about 1000 μm and with a shell thickness in a range from about 5 to about 25% of said diameter. Both the diameter and the shell thickness of the resultant receptacle may be tunable by changing the microfluidic geometry (e.g. of the injection tube, collection tube of outer tube), and/or the viscosities and/or fluid rates of the inner, middle and/or outer fluids.

Finally, in some approaches, the shell of the resultant receptacle may be treated so that it undergoes a liquid to solid transition via known methods, including but not limited to, photocrosslinking, interfacial polymerization, UV photopolymerization, etc. In addition, multiple devices (e.g. devices including the above described injection tube, collection tube and outer tube) may be stacked in sequence or multiple devices may be fed into a single device so that receptacles within receptacles may be formed with different inner fluids contained within each receptacle, while also allowing control over the number of receptacles present within a larger receptacle.

Figure 3:
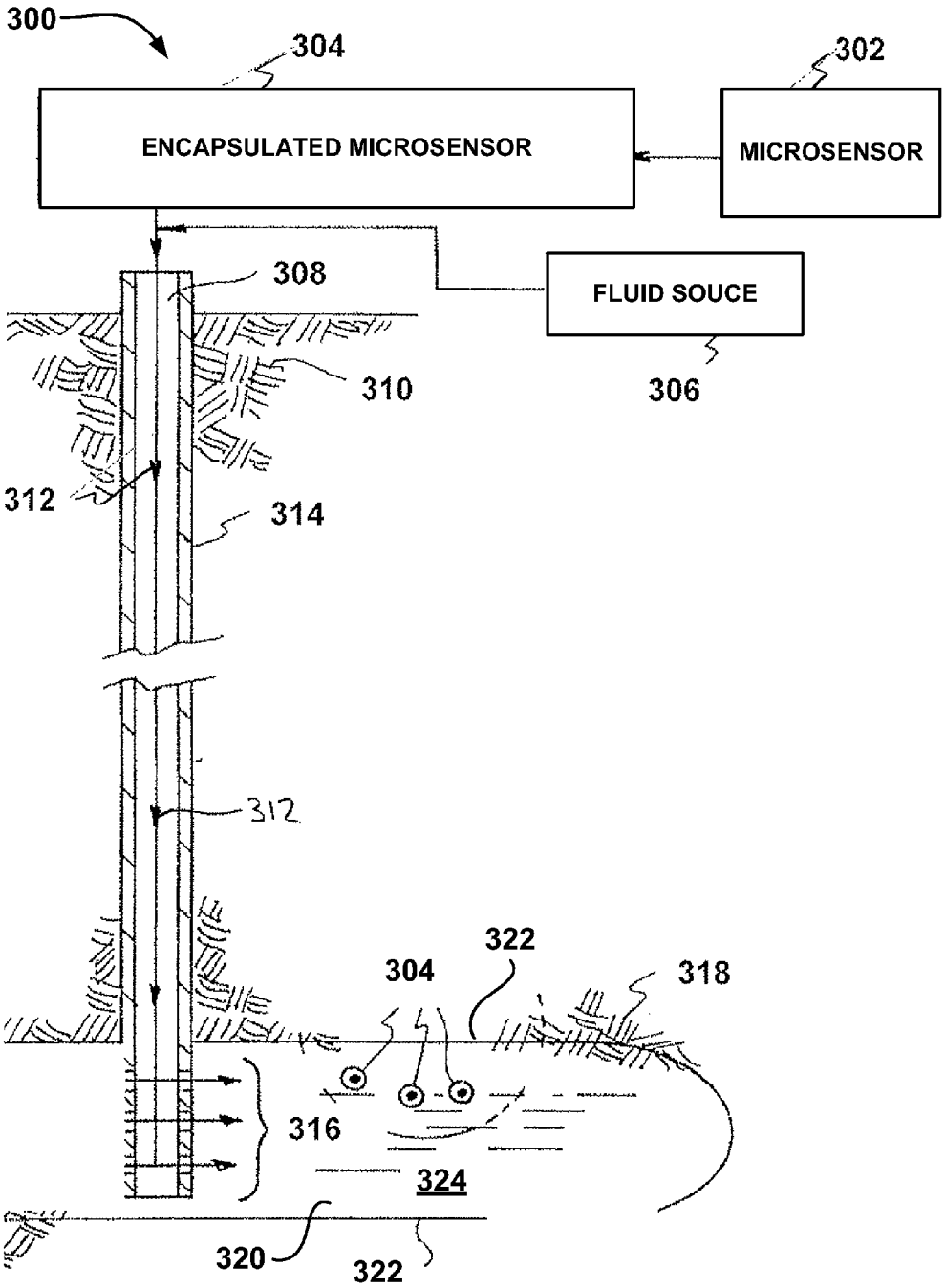
FIG. 3 illustrates a schematic diagram of a system for performing reservoir interrogation, according to one embodiment.

Referring now to FIG. 3, a schematic diagram of a system 300 for performing reservoir interrogation, e.g. for detecting and/or transmitting and/or analyzing one or more conditions of a fluidic medium of a reservoir, is shown according to one illustrative embodiment. As an option, system 300 may be implemented in conjunction with features from any other embodiment listed herein, such as those described with reference to the other FIGS. Of course, the system 300 and others presented herein may be used in various applications and/or in permutations, which may or may not be specifically described in the illustrative embodiments listed herein. Further, the system 300 presented herein may be used in any desired environment.

As shown in FIG. 3, one or more microsensors 302 are encapsulated into a receptacle, thereby yielding an encapsulated microsensor 304. It is important to note that the receptacle may include a plurality of microsensors 302 in some approaches. In additional approaches, the system 300 may include a plurality of receptacles, each of which may encapsulate one or more microsensors 302.

In one embodiment the microsensor 302 may comprise an microelectrical sensor, a micromechanical sensor, a microchemical sensor, a microoptical sensor, a microchip or other such suitable sensor as would be understood by one having skill in the art upon reading the present disclosure.

With continued reference to FIG. 3, the encapsulated microsensor 304 is fed into a well 308 using fluid from a fluid source 306. The well 308 comprises a casing 314. Additionally, the well 308 extends into the earth 310 and into a formation 318, where the formation 318 is disposed in the earth 310.

The injection well 308 also extends into a reservoir 320, where the reservoir 320 is disposed in the formation 318 and is defined by a boundary 322.

As shown in FIG. 3, the encapsulated microsensor 304 subsequently travels down the well 308 as illustrated by arrows 312. The encapsulated microsensor 304 continues into the reservoir 320, as indicated by arrows 316.

In some approaches, the receptacle may comprise a porous material that facilitates communication/contact between a fluidic medium 324 of the reservoir 320 and the microsensor 302. The fluidic medium of the reservoir 324 may comprise one of more gases, fluids, fluids adapted for/used in oil recovery operations (e.g. caustic floods, steam floods, carbon dioxide floods, polymer floods, micellar-polymer floods, etc.), geothermal brine, crude oil, ground water, hazardous waste, etc.

Again referring to FIG. 3, the microsensor 102 may be configured to detect and/or record one or more conditions of the fluidic medium 324 in the reservoir 320. For instance, the microsensor 302 may be configure to detect and/or record one or more conditions of the fluidic medium 324 in the reservoir when at least a portion of the fluidic medium 324 passes through the receptacle such that the microsensor 302 comes into direct physical contact with the fluidic medium 324.

In various approaches, the one or more conditions of the fluidic medium 324 may include, but is not limited to, a flow path(s), a temperature, a pressure, a density, a sweep efficiency, a fluid conductivity, a thermal conductivity, a chemical composition, a pH, a velocity, a turbidity, types of fluids and/or analytes at given depths, and other such conditions as would be understood by one having skill in the art upon reading the present disclosure.

According to one approach, the microsensor 302 encapsulated in the receptacle may be configured to transmit the detected one or more conditions of the fluidic medium 324 of the reservoir 320. See e.g. 414 in FIG. 4. In some approaches, the microsensor 302 may transmit the detected one or more conditions via acoustic waves, radio frequency waves, electromagnetic waves, etc.

Systems for transmitting information in a fluid are disclosed in U.S. Pat. No. 7,423,931, which is herein incorporated by reference in its entirety. One of the systems for transmitting information in a fluid disclosed in U.S. Pat. No. 7,423,931, uses a transmitter comprised of an acoustic transducer and associated electronics for pulse or waveform generation. This frequency range allows the use of well-developed technology for the acoustic hardware, which is relatively inexpensive and allows for a good compromise between power and size. Moreover, the sound waves in this frequency range can propagate long distances in water and are above/higher than most of the noise sources in the pipeline. This system operates by exposing the transducer to a fluid, after which the transducer sends an acoustic signal that propagates through the fluid. The acoustic signal is then received by a receiver, which is composed of a receiving transducer, associated amplifiers and filters. The signal received by the receiver may then be digitized electronically, and processed for an intended application.

Figure 5:
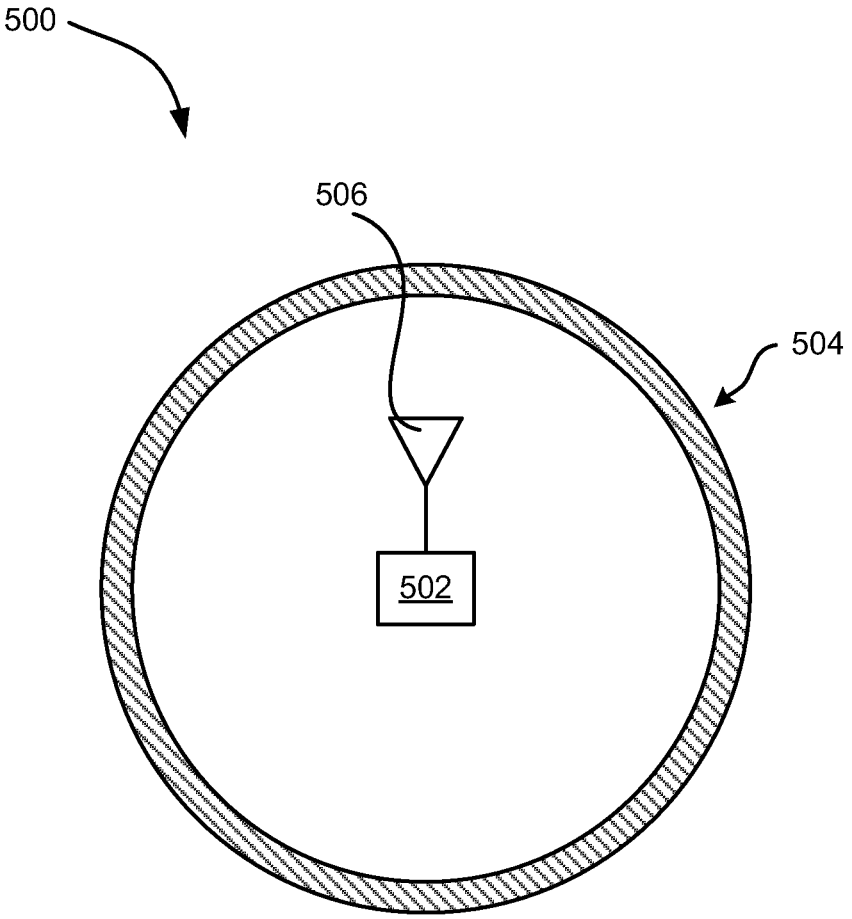
FIG. 5 illustrates a schematic diagram of an encapsulated microsensor, according to one embodiment.

In numerous approaches, a microsensor 302 that is configured to transmit the detected one or more conditions of the fluidic medium may include at least one antenna (e.g. 506 in FIG. 5).

In other approaches, the microsensor 302 may include a radio frequency communication device, e.g. a Radio Frequency Identification (RFID) tag. The radio frequency data communication device may include an at least an integrated circuit and at least one antenna connected to the integrated circuit for radio frequency transmission and reception by the integrated circuit. For purposes of this disclosure, including the appended claims, the term "integrated circuit" and "circuit" shall be defined as a combination of interconnected circuit elements associated on or within a continuous substrate. The integrated circuit may include a receiver and a transmitter. In some embodiments, separate antennas may be provided for the receiver and transmitter of the integrated circuit. In other embodiments, the receiver and transmitter sections may share a single antenna.

Figure 4:
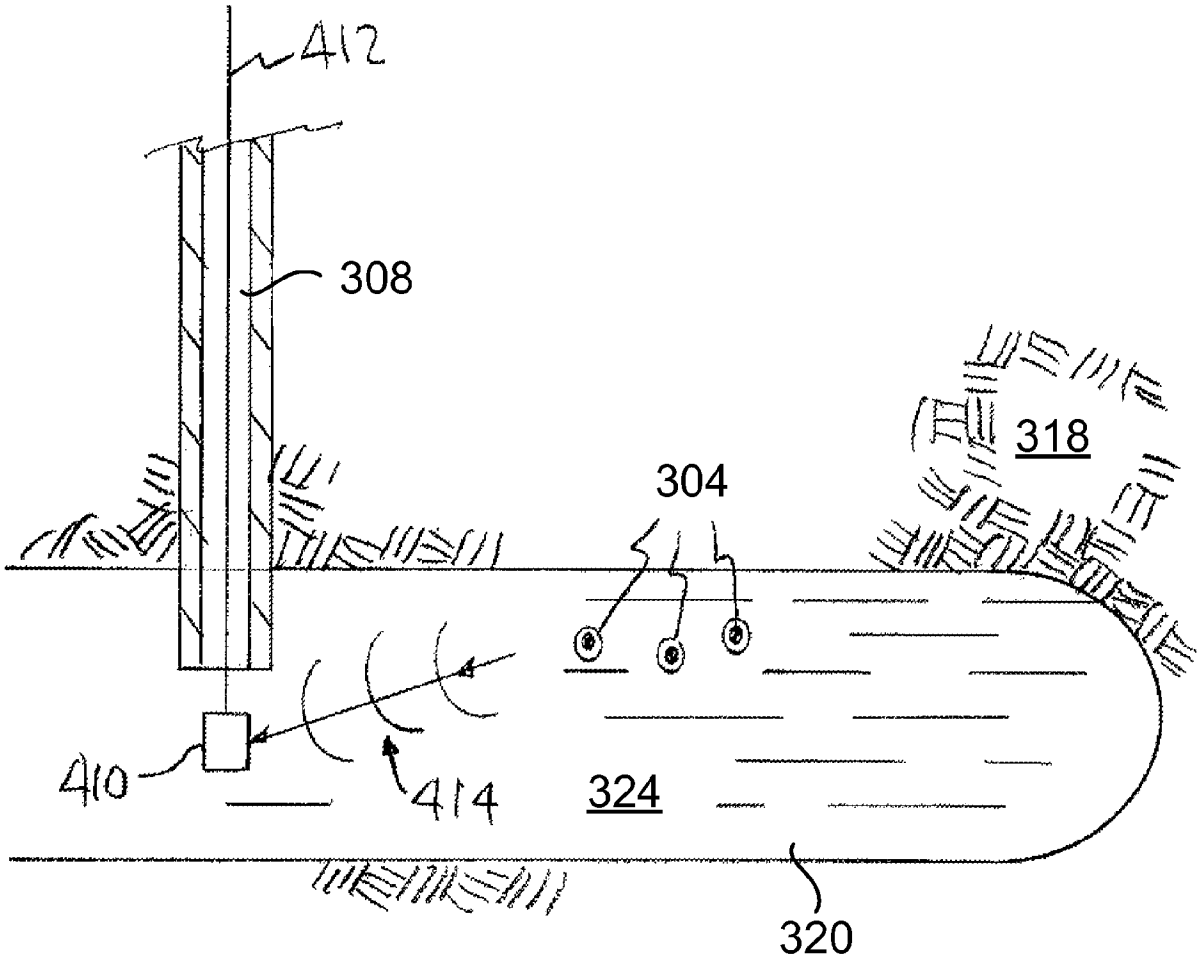
FIG. 4 illustrates a schematic diagram of a system for performing reservoir interrogation, according to one embodiment.

According to yet another embodiment, the system 300 may also include a mechanism to receive the transmitted one or more conditions of the fluidic medium 324 that were detected by the microsensor 302. For example, as shown in FIG. 4, the mechanism to receive the transmitted one or more conditions of the fluidic medium may include a first device 410 (e.g. a RFID reader, a receiver of a type known in the art, etc.) remote from the encapsulated microsensor 304. As shown in FIG. 4, this first device 410 may be disposed in the fluidic medium 324 of the reservoir 320 near to the well 308. In some approaches this first device 410 may be located vertically or horizontally adjacent to, or directly attached to, a portion of the well 308. In other approaches, the first device 410 may be located outside the fluidic medium 324 of the reservoir 320. For example, the first device may be located between an upper surface of the formation 318 and an upper surface of the fluidic medium 324 of the reservoir, located between an upper surface of the earth 310 and the upper surface of the formation 318, located above an upper surface of the earth 310, etc.

In more approaches, the first device 410 may, in turn, transmit the received one or more conditions to a second device (e.g. a second receiver, not shown in FIG. 4). This second device may be located above the earth 310 in various approaches. Further, this second device may include, but is not limited to, a computing device, e.g. a desktop computer, laptop computer, a hand-held computer, etc.

In numerous approaches the first device 410 may communicate with (e.g. transmit the one or more conditions to) the second device via a wire/cable 412, shown in FIG. 4. This wire/cable 412 may also be used to lower the first device 410 down the well 308 to a desired position near to, or into, the reservoir 320. In various other approaches, the first device 410 may communicate with (e.g. transmit the one or more conditions to) the second device utilizing a network (e.g. a private intranet, a Local Area Network (LAN), a Wide Area Network (WAN), a Virtual Local Area Network (VLAN), or some other type of communication). Various combinations of wired, wireless (e.g., radio frequency), and optical communication links may also be utilized as the communication medium between the first device 410 and the second device.

According to a further embodiment, the system 300 may also include a mechanism for analyzing the one or more conditions of the fluidic medium 324 detected/recorded and/or transmitted by the microsensor 302. In some approaches, the first and/or second device discussed directly above may be configured to analyze the detected one or more conditions of the fluidic medium 234. In numerous approaches, the analysis of the detected one or more conditions of the fluidic medium 324 may provide information relating to one or more characteristics of the reservoir 320 itself. For example, the one or more characteristics of the reservoir 320 may include, but is not limited to, a storage volume, a temperature, a size, a topography/shape, a presence of one or more pathways/channels, an interconnectedness of one or more independent channels/pathways within the reservoir, etc.

In even more approaches, the receptacle encapsulating the microsensor 302 may be configured to at least partially dissolve or degrade when at least one of the one or more conditions of the fluidic medium is about equal to, less than or greater than a predetermined value. For example, in one embodiment, the receptacle may be configured to at least partially dissolve or degrade when the microsensor 302 detects (or the receptacle itself detects) that a temperature of the fluidic medium 324 exceeds a predetermined temperature. In another embodiment, the receptacle encapsulating the microsensor 302 may be configured to at least partially dissolve or degrade when at least one of the one or more conditions of the fluidic medium is about equal to, less than or greater than a predetermined value for a predetermined length of time. In yet another embodiment, the receptacle encapsulating the microsensor 302 may be configured to at least partially dissolve or degrade after a predetermined length of time. The predetermined value and/or predetermined length of time may be set by a user, by historical operating conditions or preferences or be referenced in a table or database, etc. In cases where the receptacle at least partially degrades or dissolves, the microsensor 302 may still be configured to transmit the detected one or more conditions of the fluidic medium to at least one remote device/receiver.

According to one embodiment, the system 300 may include a first receptacle encapsulating a first microsensor, where the first receptacle may be configured to release the first microsensor (e.g. be configured to at least partially dissolve/degrade), when a first condition (or a first set of conditions) of the fluidic medium is at least equal to, less than or greater than a predetermined value. The system 300 may also include a second receptacle encapsulating a second microsensor, where the second receptacle may be configured to release the second microsensor (e.g. be configured to at least partially dissolve/degrade), when a second condition (or a second set of conditions) of the fluidic medium is about equal to, less than, or greater than a predetermined value. In some approaches, the first and second conditions (or the first set and second set of conditions) are different from one another. For example, the first receptacle may dissolve/degrade, thereby releasing the first microsensor(s) when the fluidic medium exceeds a predetermined temperature value, and the second receptacle may dissolve/degrade, thereby releasing the second microsensor(s) when the fluidic medium exceeds a predetermined pressure value. These predetermined values corresponding to one or more conditions of the fluidic medium may be set by a user, referenced in a table or database, based on historic operating conditions, etc. Moreover, the system 300 may include a plurality of receptacles each of which encapsulate one or more microsensors, and each of which may be configured to dissolve/degrade when different/distinct conditions of the fluidic medium are about equal to, less than or greater than their respective predetermined values.

According to another embodiment, the first and second receptacles described directly above may be configured to at least partially dissolve/degrade (e.g. be configured to release their respective microsensor(s)) when the same condition (or the same set of conditions) is about equal to, less than or greater than a predetermined value (or predetermined values). However, in some approaches, e.g. where the first and second receptacles are comprised of different materials, different sizes, shapes, and/or different wall thicknesses, the first and second receptacles may be configured to at least partially dissolve/degrade at different times. For example, in some approaches, the first receptacle may be configured to dissolve/degrade when the first receptacle (or its encapsulated microsensor(s)) is immediately exposed to a temperature of the fluidic medium that is about equal to, less than or greater than a predetermined temperature value. Conversely, the second receptacle may be configured to dissolve/degrade only after prolonged exposure to the same release trigger (e.g. the temperature of the fluidic medium that is about equal to, less than or greater than the predetermined temperature value).

Referring to FIG. 5, a schematic diagram of a system 500 comprising a microsensor configured to transmit one or more conditions of a fluidic medium is shown in accordance with one embodiment. As an option, the system 500 may be implemented in conjunction with features from any other embodiment listed herein, such as those described with reference to the other FIGS. Of course, the system 500 and others presented herein may be used in various applications and/or in permutations, which may or may not be specifically described in the illustrative embodiments listed herein. Further, the system 500 presented herein may be used in any desired environment.

As shown in FIG. 5, a microsensor 502 may be encapsulated in a receptacle 504. In some approaches the microsensor may be configured to detect one or more conditions of a fluidic medium of a reservoir and transmit the detected one or more conditions. Accordingly, the microsensor may comprise an antenna 506 configured to facilitate the transmission of the detected one or more conditions of the fluidic medium.

Figure 6:
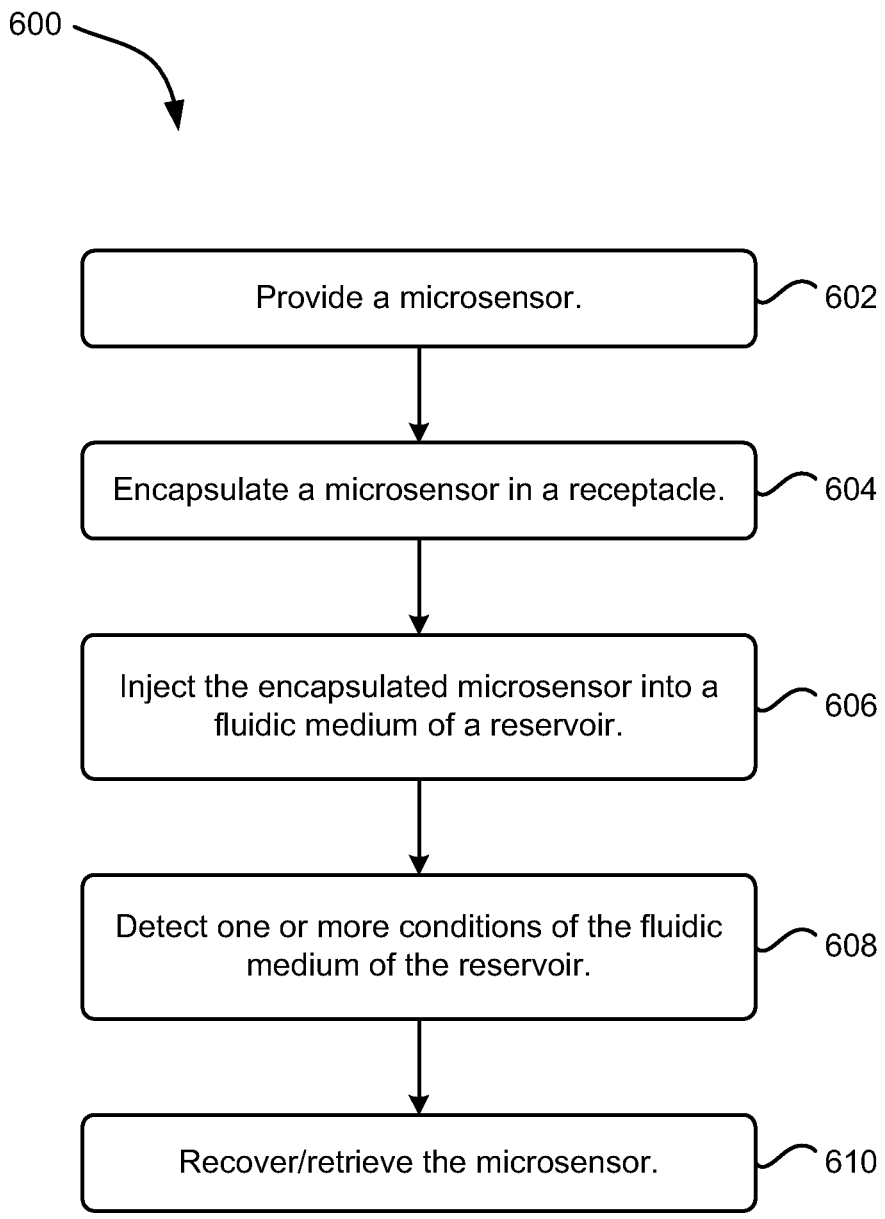
FIG. 6 is a flowchart of a method, according to one embodiment.

Now referring to FIG. 6, a flowchart of a method 600 for reservoir interrogation is shown in accordance with one embodiment. As an option, the present method 600 may be implemented in conjunction with features from any other embodiment listed herein, such as those shown in the other FIGS. described herein. Of course, this method 600 and others presented herein may be used in various applications and/or permutations, which may or may not be related to the illustrative embodiments listed herein. Further, the methods presented herein may be carried out in any desired environment. Moreover, more or less operations than those shown in FIG. 6 may be included in method 600, according to various embodiments. It should also be noted that any of the aforementioned features may be used in any of the embodiments described in accordance with the various methods.

As shown in FIG. 6, at least one microsensor is provided. See operation 602. In preferred approaches, the at least one microsensor may be configured to detect one of more conditions of a fluidic medium of a reservoir. These one or more conditions of the fluidic medium may include, but is not limited to, a flow path(s), a temperature, a pressure, a density, a sweep efficiency, a fluid conductivity, a thermal conductivity, a chemical composition, a pH, a turbidity, types of fluids and/or analytes at given depths, a velocity, and other such conditions as would be understood by one having skill in the art upon reading the present disclosure.

In some approaches, the at least one microsensor may include a microelectrical sensor, a micromechanical sensor, a microchemical sensor, a microoptical sensor, a microchip, or other known sensor.

The method 600 also includes encapsulating the at least one microsensor in a receptacle. See operation 604. In some approaches, a plurality of microsensors may be encapsulated into a receptacle. In such approaches, each of the plurality of microsensors may comprise a type of sensor (e.g. a microelectrical sensor, a microchemical sensor, a micromechanical sensor, a microoptical sensor, a microchip, etc.) that is different, the same, or a combination thereof, from one another. Additionally, in such approaches, each of the plurality of microsensors may be configured to detect the same or different conditions of the fluidic medium of the reservoir.

In more approaches, a material and a wall thickness of the receptacle may be selected depending on the particular/desired application. For example, in one embodiment, the receptacle may comprise a material configured to facilitate contact/communication between the encapsulated at least microsensor and a fluidic medium of the reservoir. In another embodiment, the receptacle may comprise a porous material. In yet another embodiment, the receptacle may comprise a polymer, or other suitable cross-linkable materials known in the art.

As shown in operation 606 of FIG. 6, the at least one encapsulated microsensor is injected into a fluidic medium of the reservoir. The fluidic medium of the reservoir may comprise one or more gases, one of more fluids, fluids adapted for/used in oil recovery operations (e.g. caustic floods, steam floods, carbon dioxide floods, polymer floods, micellar-polymer floods, etc.), geothermal brine, crude oil, ground water, hazardous waste, etc. Once injected into the fluidic medium, the at least one microsensor then detects one or more conditions of the fluidic medium of a reservoir. See operation 608.

In one embodiment, the receptacle may comprise a material configured to remain intact when exposed to the fluidic medium. In such a case, the at least one microsensor may detect the one or more conditions of the fluidic medium while encapsulated within the receptacle.

In another embodiment, the receptacle may comprise a material configured to dissolve/degrade (thereby releasing the microsensor into the fluidic medium) when one or more conditions of the fluidic medium is about equal to, less than or greater than a predetermined value. Accordingly, in some approaches, receptacle may dissolve/degrade prior to the at least one microsensor's detection of the one or more conditions of the fluidic medium. In other approaches, the receptacle may dissolve/degrade during or after the at least microsensor's detection of the one or more conditions of the fluidic medium.

With continued reference to FIG. 6, the method 600 additionally includes recovering/retrieving the at least one microsensor. See operation 610. In some approaches, the at least microsensor may be recovered/retrieved while still encapsulated in the receptacle. In other approaches, the at least one microsensor may be recovered/retrieved, where the at least one microsensor is no longer encapsulated in the receptacle. In more approaches, the at least one microsensor may be removed from the fluidic medium.

In even more approaches, the method 600 may optionally include collecting/obtaining and/or analyzing the detected one of more conditions of the fluidic medium of the reservoir. Analysis of the detected one or more conditions of the fluidic medium may provide information relating to one or more characteristics of the reservoir itself. For example, the one or more characteristics of the reservoir may include, but is not limited to, a storage volume, a temperature, a size of the reservoir, a topography/shape of the reservoir, a presence of one or more pathways/channels, an interconnectedness of one or more independent channels/pathways within the reservoir, etc.

Figure 7:
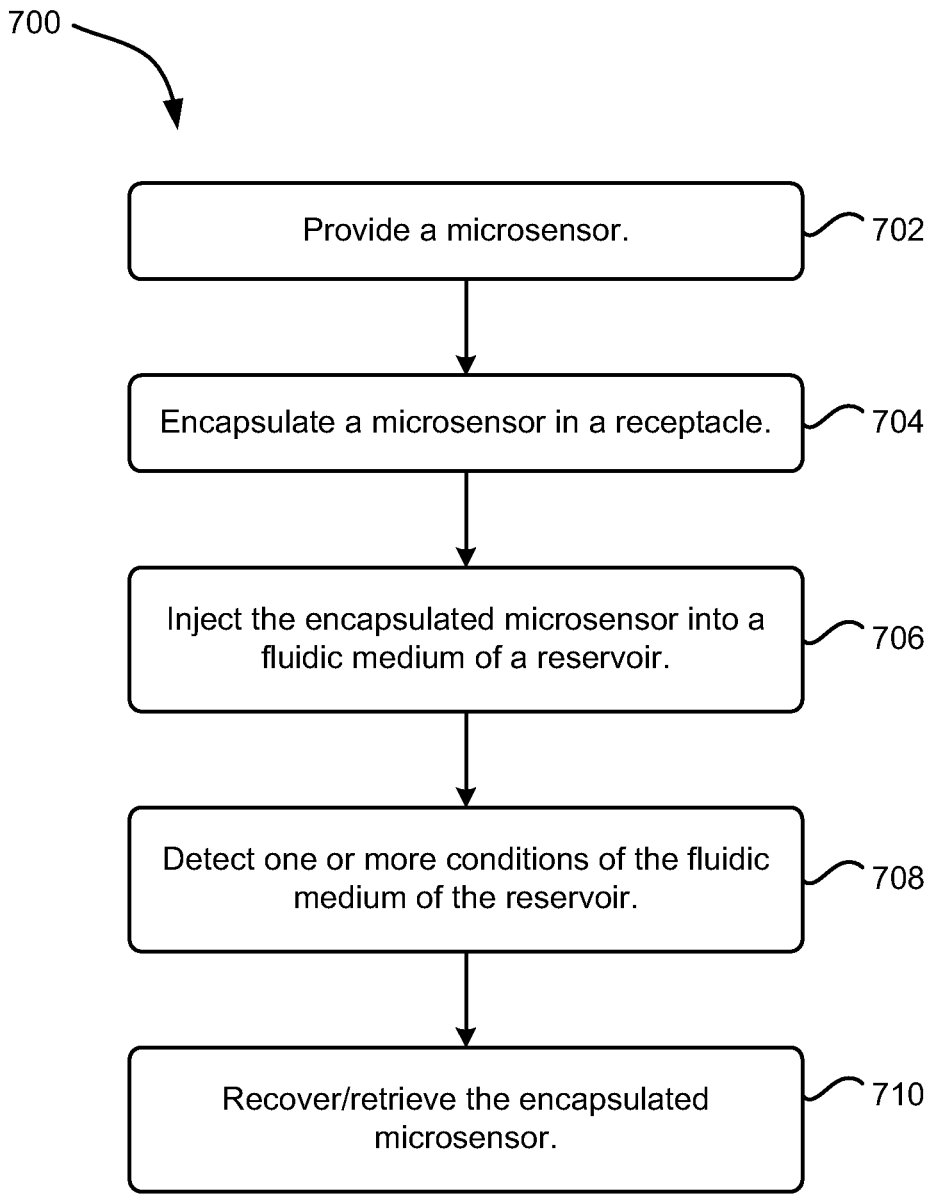
FIG. 7 is a flowchart of a method, according to one embodiment.

Referring now to FIG. 7, a flowchart of a method 700 for reservoir interrogation is shown in accordance with one exemplary embodiment. As an option, the present method 700 may be implemented in conjunction with features from any other embodiment listed herein, such as those shown in the other FIGS. described herein. Of course, this method 700 and others presented herein may be used in various applications and/or permutations, which may or may not be related to the illustrative embodiments listed herein. Further, the methods presented herein may be carried out in any desired environment. Moreover, more or less operations than those shown in FIG. 7 may be included in method 700, according to various embodiments. It should also be noted that any of the aforementioned features may be used in any of the embodiments described in accordance with the various methods.

As shown in FIG. 7, at least one microsensor is provided. See operation 702. In preferred approaches, the at least one microsensor may be configured to detect one of more conditions of a fluidic medium of a reservoir. In further approaches, the at least one microsensor may include a microelectrical sensor, a micromechanical sensor, a microchemical sensor, a microoptical sensor, a microchip, or other known sensor.

The method 700 also includes encapsulating the at least one microsensor in a receptacle. See operation 704. In some approaches, a plurality of microsensors may be encapsulated into a receptacle. In such approaches, each of the plurality of microsensors may comprise a type of sensor (e.g. a microelectrical sensor, a microchemical sensor, a micromechanical sensor, a microoptical sensor, a microchip, etc.) that is different, the same, or a combination thereof, from one another. Additionally, in such approaches, each of the plurality of microsensors may be configured to detect the same or different conditions of the fluidic medium of the reservoir.

In more approaches, a material and a wall thickness of the receptacle may be selected depending on the particular/desired application. For example, in one embodiment, the receptacle may comprise a material configured to facilitate contact/communication between the encapsulated at least microsensor and a fluidic medium of the reservoir. In another embodiment, the receptacle may comprise a porous material. In yet another embodiment, the receptacle may comprise a polymer, or other suitable cross-linkable materials known in the art.

As shown in operation 706 of FIG. 7, the encapsulated at least one microsensor is injected into a fluidic medium of the reservoir. The fluidic medium of the reservoir may comprise one or more gases, one of more fluids, fluids adapted for/used in oil recovery operations (e.g. caustic floods, steam floods, carbon dioxide floods, polymer floods, micellar-polymer floods, etc.), geothermal brine, crude oil, ground water, hazardous waste, etc. Once injected into the fluidic medium, the at least one microsensor then detects one or more conditions of the fluidic medium of a reservoir in operation 708.

As depicted in FIG. 7, the receptacle may comprise a material configured to remain intact when exposed to the fluidic medium. In such a case, the at least one microsensor may detect the one or more conditions of the fluidic medium while encapsulated within the receptacle.

In operation 710, the encapsulated at least one microsensor is recovered/retrieved. In some approaches, the encapsulated at least one microsensor may be removed from the fluidic medium.

In more approaches, the method 700 may optionally include collecting/obtaining and/or analyzing the detected one of more conditions of the fluidic medium of the reservoir. Analysis of the detected one or more conditions of the fluidic medium may provide information relating to one or more characteristics of the reservoir itself. For example, the one or more characteristics of the reservoir may include, but is not limited to, a storage volume, a temperature, a size of the reservoir, a topography/shape of the reservoir, a presence of one or more pathways/channels, an interconnectedness of one or more independent channels/pathways within the reservoir, etc.

Figure 8:
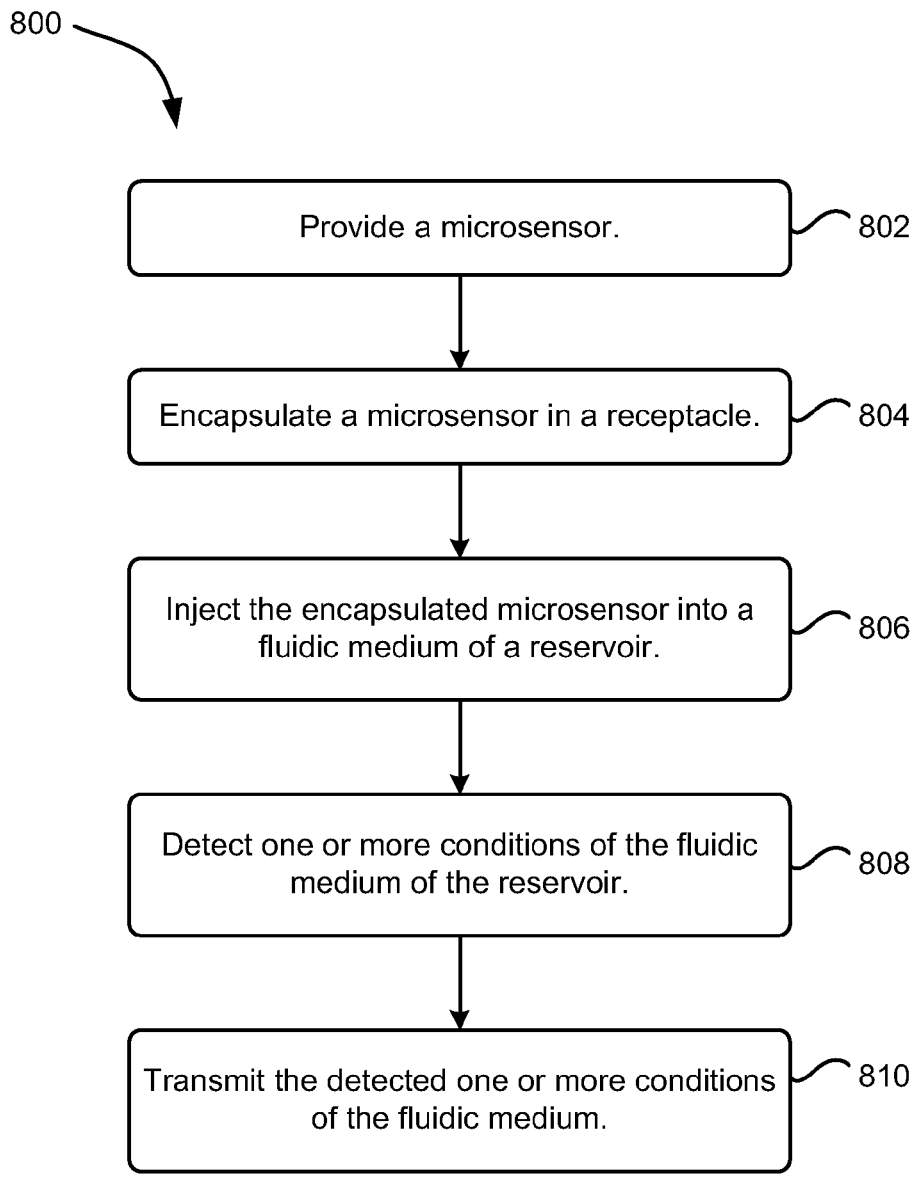
FIG. 8 is a flowchart of a method, according to one embodiment.

Now referring to FIG. 8, a flowchart of a method 800 for reservoir interrogation in accordance with one embodiment. As an option, the present method 800 may be implemented in conjunction with features from any other embodiment listed herein, such as those shown in the other FIGS. described herein. Of course, this method 800 and others presented herein may be used in various applications and/or permutations, which may or may not be related to the illustrative embodiments listed herein. Further, the methods presented herein may be carried out in any desired environment. Moreover, more or less operations than those shown in FIG. 8 may be included in method 800, according to various embodiments. It should also be noted that any of the aforementioned features may be used in any of the embodiments described in accordance with the various methods.

As shown in FIG. 8, at least one microsensor is provided. See operation 802. In preferred approaches, the at least one microsensor may be configured to detect one of more conditions of a fluidic medium of a reservoir. These one or more conditions of the fluidic medium may include, but is not limited to, a flow path(s), a temperature, a pressure, a density, a sweep efficiency, a fluid conductivity, a thermal conductivity, a chemical composition, a pH, a turbidity, types of fluids and/or analytes at given depths, a velocity, and other such conditions as would be understood by one having skill in the art upon reading the present disclosure.

In some approaches, the at least one microsensor may include a microelectrical sensor, a micromechanical sensor, a microchemical sensor, a microoptical sensor, a microchip, or other known sensor.

The method 800 also includes encapsulating the at least one microsensor in a receptacle. See operation 804. In some approaches, a plurality of microsensors may be encapsulated into a receptacle. In such approaches, each of the plurality of microsensors may comprise a type of sensor (e.g. a microelectrical sensor, a microchemical sensor, a micromechanical sensor, a microoptical sensor, a microchip, etc.) that is different, the same, or a combination thereof, from one another. Additionally, in such approaches, each of the plurality of microsensors may be configured to detect the same or different conditions of the fluidic medium of the reservoir.

In more approaches, a material and a wall thickness of the receptacle may be selected depending on the particular/desired application. For example, in one embodiment, the receptacle may comprise a material configured to facilitate contact/communication between the encapsulated at least microsensor and a fluidic medium of the reservoir. In another embodiment, the receptacle may comprise a porous material. In yet another embodiment, the receptacle may comprise a polymer, or other suitable cross-linkable materials known in the art.

As shown in operation 806 of FIG. 8, the at least one encapsulated microsensor is injected into a fluidic medium of the reservoir. The at least one microsensor then detects one or more conditions of the fluidic medium of a reservoir in operation 808.

In one embodiment, the receptacle may comprise a material configured to remain intact when exposed to the fluidic medium. In such a case, the at least one microsensor may detect the one or more conditions of the fluidic medium while encapsulated within the receptacle.

In another embodiment, the receptacle may comprise a material configured to dissolve/degrade (thereby releasing the microsensor into the fluidic medium) when one or more conditions of the fluidic medium is about equal to, less than or greater than a predetermined value. Accordingly, in some approaches, the receptacle may dissolve/degrade prior to the at least one microsensor's detection of the one or more conditions of the fluidic medium. In other approaches, the receptacle may dissolve/degrade during or after the at least microsensor's detection of the one or more conditions of the fluidic medium.

With continued reference to FIG. 8, the method 800 additionally includes transmitting the detected one or more conditions of the fluidic medium. See operation 810. In some approaches, the at least one microsensor may transmit the detected one or more conditions to one or more remote devices/receivers.

The method 800 may also optionally include recovering/retrieving the at least one microsensor. In some approaches, the at least microsensor may be recovered/retrieved while still encapsulated in the receptacle. In other approaches, the at least one microsensor may be recovered/retrieved, where the at least one microsensor is no longer encapsulated in the receptacle. In more approaches, the at least one microsensor may be removed from the fluidic medium.

Further, the method 800 may optionally include collecting/obtaining and/or analyzing the detected one of more conditions of the fluidic medium of the reservoir. Analysis of the detected one or more conditions of the fluidic medium may provide information relating to one or more characteristics of the reservoir itself. For example, the one or more characteristics of the reservoir may include, but is not limited to, a storage volume, a temperature, a size of the reservoir, a topography/shape of the reservoir, a presence of one or more pathways/channels, an interconnectedness of one or more independent channels/pathways within the reservoir, etc.

Figure 9:
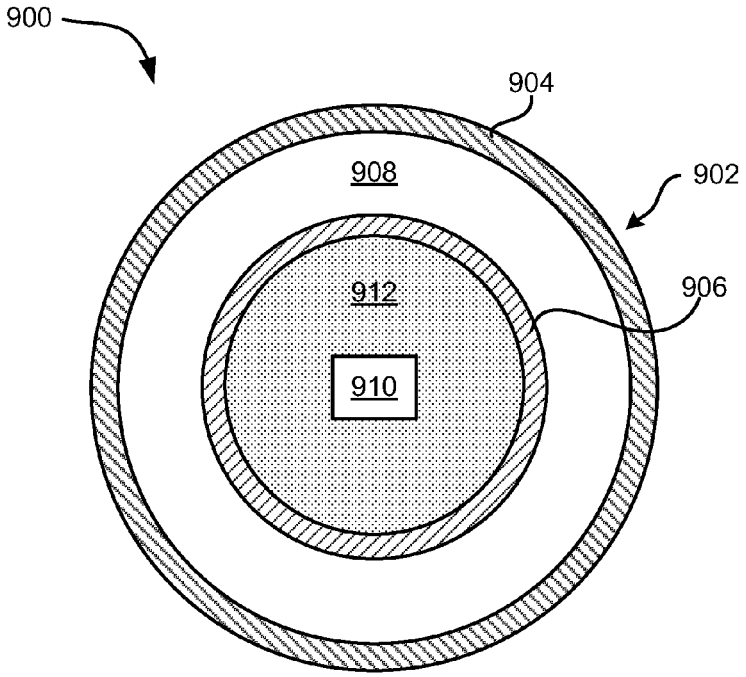
FIG. 9 illustrates a schematic diagram of an encapsulated microsensor, according to one embodiment.

Referring now to FIG. 9, a schematic diagram of an encapsulated microsensor 900 is shown according to one illustrative embodiment. As an option, the encapsulated microsensor 900 may be implemented in conjunction with features from any other embodiment listed herein, such as those described with reference to the other FIGS. Of course, the encapsulated microsensor 900 and others presented herein may be used in various applications and/or in permutations, which may or may not be specifically described in the illustrative embodiments listed herein. Further, the encapsulated microsensor 900 presented herein may be used in any desired environment.

As shown in FIG. 9, a receptacle 902 may comprise a first shell 904 and a second shell 906, where the first and second shells (904, 906) are concentric and where the second shell 906 is contained/encapsulated in the first shell 904. While the first and second shells (904, 906) are shown having a spherical shape, it is important to note that the first and second shells (904, 906) may include a rectangular, elliptical, or other such suitable shape.

In some approaches, the first shell 904 may comprise a material configured to allow passage of at least a portion of the fluidic medium into an area 908, which is sandwiched between the first shell 904 and the second shell 906. The second shell 906 may also comprise a material configured to allow passage of at least a portion of the fluidic medium into an interior of the second shell 906. In numerous approaches, the first and second shell (904, 906) may comprise the same or different materials.

As also shown in FIG. 9, at least one microsensor 910 and at least one substance 912, e.g. a tracer, may be contained/encapsulated in the second shell 906 of the receptacle 902. In some embodiments, the second shell 906 may comprise a material configured to prevent passage of at least a portion of the substance 912 out of the second shell 906.

In other approaches, the at least one microsensor 910 may be configured to break the second shell 906 to release the substance 912 (e.g. by breaking at least a portion of the second shell 906, altering a porosity or other property of the second shell 906) into area 908 upon predetermined conditions. For example, in one embodiment, the microsensor 910 may be configured to release the substance 912 when one or more detected conditions of the fluidic medium is about equal to, greater than or less than a predetermined value (e.g. a temperature value specified by a user, referenced in a database or table, etc.). In another embodiment, the microsensor 910 may be configured to release the substance 912 when one or more detected conditions of the fluidic medium is about equal to, greater than or less than a predetermined value for a predetermined length of time (e.g. a length of time specified by a user, referenced in a database or table, etc.).

In yet another embodiment the microsensor 910 may be configured to operate as a timer, e.g. configured to release the substance 912 after passage of a predetermined length of time. In such cases, a start time may be specified (e.g. the time at which the microsensor 910 comes into contact with the fluidic medium of the reservoir) as well as an end time (thereby defining the predetermined length of time).

In an additional embodiment, the microsensor 910 may be configured to release the substance 912 upon receiving a signal/command to release the substance 912. In some approaches, the signal/command may be issued by a remote user, a remote device, etc. Further, in such cases, the microsensor 910 may include at least one antenna configured to receive and/or transmit such signals, commands, etc.

Figure 10:
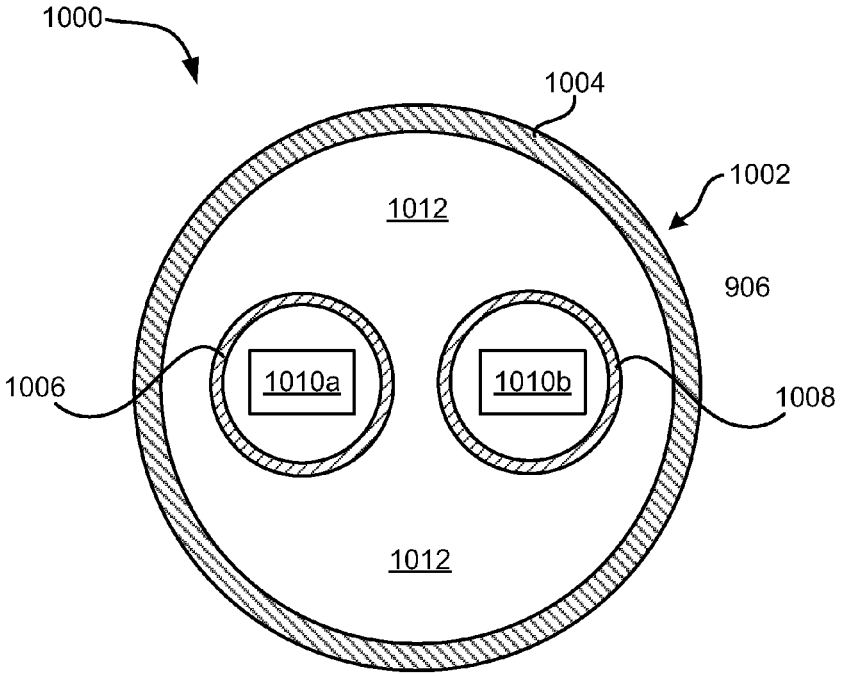
FIG. 10 illustrates a schematic diagram of two encapsulated microsensors, according to one embodiment.

Referring now to FIG. 10, a schematic diagram of an encapsulated microsensor 1000 is shown according to one illustrative embodiment. As an option, the encapsulated microsensor 1000 may be implemented in conjunction with features from any other embodiment listed herein, such as those described with reference to the other FIGS. Of course, the encapsulated microsensor 1000 and others presented herein may be used in various applications and/or in permutations, which may or may not be specifically described in the illustrative embodiments listed herein. Further, the encapsulated microsensor 1000 presented herein may be used in any desired environment.

As shown in FIG. 10, a receptacle 1002 may comprise a first shell 1004, a second shell 1006, and a third shell 1008, where the second and third shells (1006, 1008) are contained/encapsulated in the first shell 1004. As also shown, one or more microsensors 1010*a* may be contained/encapsulated in the second shell 1006, and one or more microsensors 1010*b* may be contained/encapsulated in the third shell 1008. In one embodiment, at least one of the one or more microsensors 1010*a* may be the same as at least one of the one or more microsensors 1010*b*. In another embodiment, at least one of the one or more microsensors 1010*a* may be different than at least one of the one or more microsensors 1010*b*. In preferred embodiments, the one or more microsensors 1010*a* and 1010*b* may be configured to detect one or more conditions of a fluidic medium of a reservoir (e.g. a temperature, a pressure, a pH, a chemical composition, a velocity, a thermal and/or electrical conductivity, etc. and other known fluid characteristics). In further embodiments, the one or more microsensors 1010*a* and 1010*b* may be configured to detect the same or different conditions of fluidic medium.

In some approaches, the first shell 1004 may comprises a material configured to allow passage of at least a portion of the fluidic medium into an area 1012, where the area 1012 is located between the first shell 1004 and the second shell 1006, between the first shell 1004 and the third shell 1008, and between the second shell 1006 and the third shell 1008. In more approaches, the second shell 1006 and/or third shell 1008 may also comprise a material configure to allow passage of at least portion of the fluidic medium into the centers of their respective shells, thereby facilitating communication/contact between the fluidic medium and the one or more microsensors (1010*a* and/or 1010*b*). In numerous approaches, the first shell 1004, second shell 1006, and third shell 1008 may comprise materials that are the same or different from one another, or some combination thereof.

Figure 11:
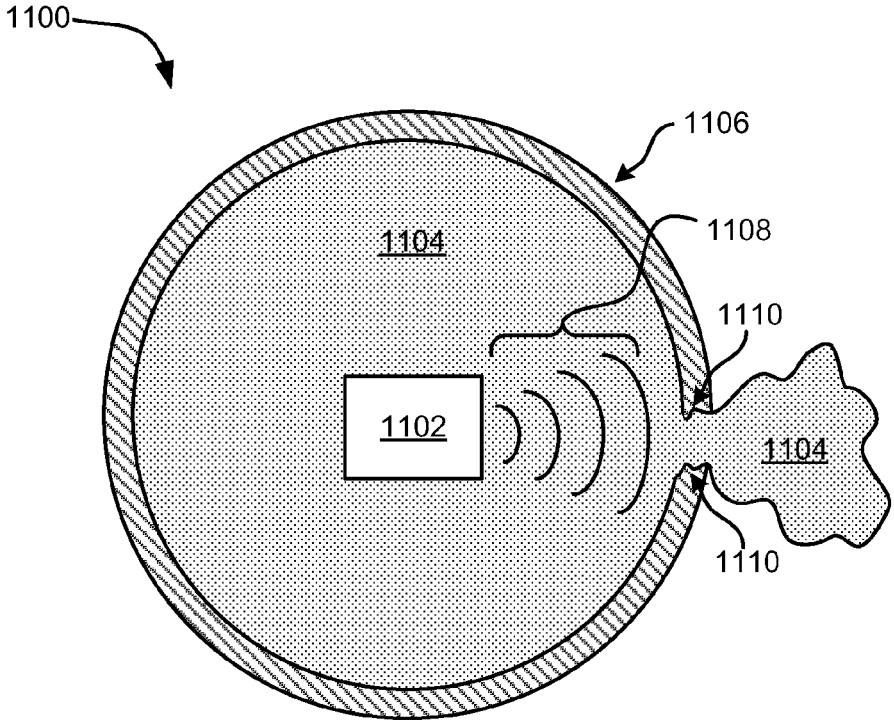
FIG. 11 illustrates a schematic diagram of an encapsulated microsensor, according to one embodiment.

Now referring to FIG. 11, a schematic diagram of an encapsulated microsensor 1100 configured to release a substance into a fluidic medium of a reservoir is shown according to one illustrative embodiment. As an option, the encapsulated microsensor 1100 may be implemented in conjunction with features from any other embodiment listed herein, such as those described with reference to the other FIGS. Of course, the encapsulated microsensor 1100 and others presented herein may be used in various applications and/or in permutations, which may or may not be specifically described in the illustrative embodiments listed herein. Further, the encapsulated microsensor 1100 presented herein may be used in any desired environment.

As shown in FIG. 11, at least one microsensor 1102 and at least one substance 1104, e.g. a tracer known in the art, are contained in a receptacle 1106. The at least one substance 1104 may fill the interior of the receptacle 1106 in some embodiments. According to various embodiments, the substance 1104 may be configured to facilitate reservoir interrogation (e.g. detection and/or analysis of one or more conditions of a fluidic medium of a reservoir), and/or configure to perform one or more operations during the formation of reservoir, a well, etc. In additional embodiments, the at least one microsensor 1102 may be configured to detect one or more conditions of a fluidic medium of a reservoir, and to also facilitate reservoir interrogation.

According to some approaches, the receptacle 1106 may be comprised of a material configured to facilitate communication/contact between the at least one microsensor 1102 and the fluidic medium of the reservoir (e.g. the material may be configured to allow passage of at least a portion of the fluidic medium into and out of the receptacle 1106). In additional approaches, the material may also be configured to prevent the passage of the substance 1104 out of the receptacle 1106.

As shown in FIG. 11, the microsensor 1102 may be configured to release the substance 1104 from the receptacle 1106. For example, in one embodiment, the microsensor 1102 may be configured to release the substance 1104 from the receptacle 1106 when one or more detected conditions of the fluidic medium is about equal to, greater than or less than a predetermined value (e.g. a temperature value specified by a user, referenced in a database or table, etc.). In another embodiment, the microsensor 1102 may be configured to release the substance 1104 when one or more detected conditions of the fluidic medium is about equal to, greater than or less than a predetermined value for a predetermined length of time (e.g. a length of time specified by a user, referenced in a database or table, etc.).

In yet another embodiment the microsensor 1102 may be configured to operate as a timer, e.g. configured to release the substance 1104 after passage of a predetermined length of time. In such cases, a start time may be specified (e.g. the time at which the receptacle 1106 and/or microsensor 1102 comes into contact with the fluidic medium of the reservoir) as well as an end time (thereby defining the predetermined length of time).

In an additional embodiment, the microsensor 1102 may be configured to release the substance 1104 upon receiving a signal/command to release the substance 1104. In some approaches, the signal/command may be issued/sent by a remote user, a remote device, etc.

In some embodiments, the microsensor 1102 may be configured to send a signal 1108 (an acoustic wave, a radio frequency wave, an electromagnetic wave, etc.) that is configured to cause a break 1110 in at least a portion of the receptacle 1106, thereby releasing the substance 1104 into the fluidic medium. In some approaches, the microsensor 1102 may be configured to send a signal 1108 that may be configured to aggregate and/or propel/direct one or more particles toward at least one portion of the receptacle, where an impact of the one or more particles on at least a portion of the receptacle 1106 causes a break 1110 in at least that portion of the receptacle 1106. These particles may be comprised of the same or different material/composition as substance 1104, may be fluids disposed in the substance 1104, etc.

In other embodiments, microsensor 1102 may be configured to send a signal 1108 that is configured to alter a property of the material of the receptacle 1106 (e.g. a porosity), thereby facilitating passage of the substance 1104 out of the receptacle 1106.

In additional embodiments, the microsensor 1102 may comprise at least one antenna to send (and/or receive) the signals 1108 described herein, as well as information/data that relates to the detected one or more conditions of the fluidic medium of the reservoir, etc.

Figure 12:
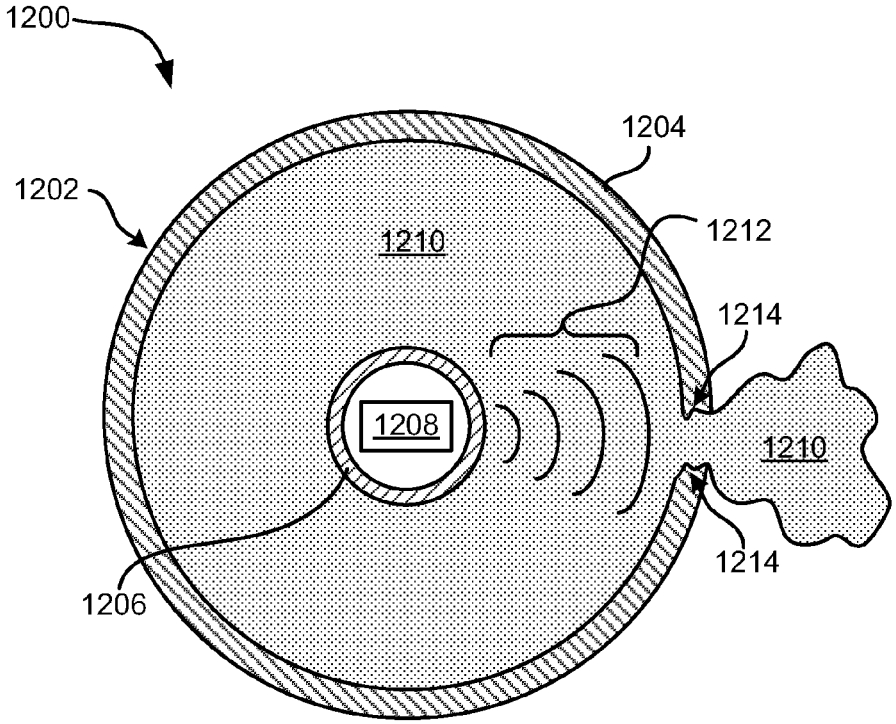
FIG. 12 illustrates a schematic diagram of an encapsulated microsensor, according to one embodiment.

Referring now to FIG. 12, a schematic diagram of an encapsulated microsensor 1200 configured to release a substance into a fluidic medium of a reservoir is shown according to another illustrative embodiment. As an option, the encapsulated microsensor 1200 may be implemented in conjunction with features from any other embodiment listed herein, such as those described with reference to the other FIGS. Of course, the encapsulated microsensor 1200 and others presented herein may be used in various applications and/or in permutations, which may or may not be specifically described in the illustrative embodiments listed herein. Further, the encapsulated microsensor 1200 presented herein may be used in any desired environment.

As shown in FIG. 12, a receptacle 1202 comprises a first shell 1204 and a second shell 1206, where the second shell 1206 is contained/encapsulated in the first shell 1204. In some approaches, the first shell 1204 and the second shell 1206 may be concentric. Additionally, while the first shell 1204 and second shell 1206 have spherical shapes as shown in FIG. 12, it is important to note that the first and second shells (1204, 1206) may also comprise a rectangular shape, an elliptical shape, or other such suitable shape.

As also shown in FIG. 12, at least one microsensor 1208 is contained/encapsulated in the second shell 1206 and a substance 1210, e.g. a tracer, is contained/encapsulate in the first shell 1204. In some approaches, the first shell 1204 and/or second shell 1206 may comprise a material configured to allow passage of the fluidic medium of the reservoir into the first and/or second shells. Passage of the fluidic medium into the first and/or second shells may facilitate communication or contact between the at least one microsensor 1208 and the fluidic medium. In additional approaches, the first shell 1204 may comprise a material that prevents the passage of the substance 1210 out of the first shell 1204 and into the fluidic medium. In further approaches, the second shell 1206 may comprise a material that prevents the passage of the substance 1210 into an interior of the second shell 1206.

As shown in FIG. 12, the microsensor 1208 may be configured to release the substance 1210 from the receptacle 1202. For example, in one embodiment, the microsensor 1208 may be configured to release the substance 1210 from the receptacle 1202 when one or more detected conditions of the fluidic medium is about equal to, greater than or less than a predetermined value (e.g. a temperature value specified by a user, referenced in a database or table, etc.). In another embodiment, the microsensor 1208 may be configured to release the substance 1210 when one or more detected conditions of the fluidic medium is about equal to, greater than or less than a predetermined value for a predetermined length of time (e.g. a length of time specified by a user, referenced in a database or table, etc.).

In yet another embodiment the microsensor 1208 may be configured to operate as a timer, e.g. configured to release the substance 1210 after passage of a predetermined length of time. In such cases, a start time may be specified (e.g. the time at which the receptacle 1202 and/or the microsensor 1208 comes into contact with the fluidic medium of the reservoir) as well as an end time (thereby defining the predetermined length of time).

In an additional embodiment, the microsensor 1208 may be configured to release the substance 1210 upon receiving a signal/command to release the substance 1210. In some approaches, the signal/command may be issued/sent by a remote user, a remote device, etc.

In some embodiments, the microsensor 1208 may be configured to send a signal 1212 (an acoustic wave, a radio frequency wave, an electromagnetic wave, etc.) that is configured to cause a break 1214 in at least a portion of the receptacle 1202, thereby releasing the substance 1210 into the fluidic medium. In some approaches, the microsensor 1208 may be configured to send a signal 1212 that may be configured to aggregate and/or propel/direct one or more particles toward at least one portion of the receptacle 1202, where an impact of the one or more particles on at least a portion of the receptacle 1202 causes a break 1214 in at least that portion of the receptacle 1202. These particles may be comprised of the same or different material/composition as substance 1210, may be fluids disposed in the substance 1210, etc.

In other embodiments, microsensor 1208 may be configured to send a signal 1212 that is configured to alter a property of the material of the receptacle 1202 (e.g. a porosity), thereby facilitating passage of the substance 1210 out of the receptacle 1202.

In additional embodiments, the microsensor 1208 may comprise at least one antenna to send (and/or receive) the signals 1212 described herein, as well as information/data that relates to the detected one or more conditions of the fluidic medium of the reservoir, etc.

In Use

Several exemplary uses and methods of using the microsensors described herein are provided below. It is important to note these uses and related methods are provided by way of example only and are not limiting in any way.

One illustrative use of the microsensors described herein may be to detect one or more conditions of hazardous waste present in a reservoir. Hazardous waste may appear, among other places, in a subterranean potable water source, in the basement of a building, etc. Accordingly, the microsensors, which may be encapsulated into a receptacle, may be injected into the reservoir containing the hazardous waste. In some approaches, the material of the receptacle may facilitate communication/contact between the microsensors and the hazardous waste. For example, the material of the receptacle may be porous and therefore facilitate direct physical contact between the hazardous waste and the microsensor (while encapsulated in the receptacle). Alternatively, the material of the receptacle may be configured to dissolve/degrade upon exposure to predetermined conditions (e.g. the receptacle and/or microsensor may detect a condition of the hazardous waste that is greater than, less than or equal to a predetermined value), and thus release the microsensor directly into the hazardous waste. However, in numerous approaches, the detection of one or more conditions of the hazardous waste (e.g. a temperature, a chemical compositions, a pH, a thermal and/or electrical conductivity, a flow path, etc.) by the microsensors, whether encapsulated or not, may provide valuable information that may aid in the extraction or management of the hazardous waste from the reservoir.

Additionally, use of the microsensors described herein may help identify the source of hazardous waste present in a reservoir. For example, there may be two or more operators that produce waste fluids proximate a reservoir containing hazardous waste. To determine which operator is responsible for the hazardous waste in the reservoir (as well as identify one or more conditions of the hazardous waste), a microsensor may be incorporated into each of the operators' waste fluids. These microsensors, which may be different from one another, may be configured to detect one of more conditions of the waste fluids, e.g. a flow path, a temperature, a chemical composition, etc. Retrieval and/or analysis of these detected conditions may therefore aid in the identification of the source and/or composition of the hazardous waste.

Another exemplary use of the microsensors described herein entails monitoring fluids injected during a steam flood. Steam flooding typically involves injecting steam in one or more injections wells, which may extend into a reservoir, using a 5-spot or 9-spot injection-producer pattern. Occasionally, early steam breakthrough occurs at a producer well. To determine which of the injection wells is channeling its injected fluid to the producer well, a microsensor may be added to each of the steam injection wells that are designed to service the affected producer well. The microsensors, which may be different from one another, may then detect one or more conditions of the produced fluids. Accordingly, by then retrieving and/or analyzing the detected conditions of the produced fluids, the injection well responsible for the early breakthrough may be identified and, once identified, remedial action may be taken.

Yet another exemplary use of the microsensors described herein entails monitoring geothermal fluids. A geothermal field generally comprises one or more production wells for producing geothermal brine from one or more subterranean geothermal reservoirs. Heat is extracted from the produced brine and the resulting modified brine is either injected into a subterranean formation through one or more injection wells or disposed of in another manner. Occasionally, water or a different brine is injected to recharge the formation. To determine whether the fluid injected into a specific injection well is adversely affecting the produced geothermal brines (e.g., causing a cooling effect), a microsensor may be incorporated into the injected fluid and at least one brine sample from one or more production wells (preferably from each of the one or more production wells). The microsensors may be different from another and may be configured to detect one or more conditions (e.g. a temperature, a pH, a pressure, etc.) of the geothermal fluids. Retrieval and/or analysis of these detected conditions may therefore aid in understanding how the injected fluids are affecting the produced geothermal brines. Moreover, by judiciously selecting the microsensors, a single analysis method may be used to analyze the detected one or more conditions, thereby saving a significant amount of analytical time, effort, and money.

While various embodiments have been described above, it should be understood that they have been presented by way of example only, and not limitation. For example, any one embodiment may be implemented in conjunction with features from any other embodiment listed herein, such as those described with reference to the other FIGS. Further, the embodiments may be used in various applications, devices, systems, methods, etc. and/or in various permutations, which may or may not be specifically described in the illustrative embodiments listed herein. Thus, the breadth and scope of the embodiments should not be limited by any of the above-described exemplary embodiments, but should be defined only in accordance with the following claims and their equivalents.

What is claimed is:

1. A system, comprising:

at least one microsensor configured to detect one or more conditions of a fluidic medium of a reservoir; and a receptacle, wherein the receptacle encapsulates the at least one microsensor, wherein the receptacle has a diameter in a range from about 1 μm to about 1000 μm, wherein the receptacle includes an outer shell having a thickness in a range from about 5% to about 35% of the diameter of the receptacle, wherein the at least one microsensor is configured to cause a rupture in at least a portion of the outer shell in response to detecting that at least one of the one or more conditions of the fluidic medium is about equal to, less than or greater than a predetermined value.

2. The system of claim 1, wherein the receptacle comprises a porous material configured to facilitate contact between the fluidic medium and the at least one microsensor.

3. The system of claim 1, wherein the at least one microsensor is in direct physical contact with the fluidic medium.

4. The system of claim 1, wherein the at least one microsensor is selected from a group consisting of: a microelectrical sensor, a micromechanical sensor, a microchemical sensor, and a microoptical sensor.

5. The system of claim 1, wherein the at least one microsensor is configured to record and/or transmit the one or more detected conditions of the fluidic medium.

6. The system of claim 1, further comprising at least one of: a mechanism configured to obtain and/or receive the one or more conditions of the fluidic medium, a mechanism configured to inject the at least one microsensor into the fluidic medium, and a mechanism configured to retrieve the at least one microsensor into the fluidic medium.

7. The system of claim 1, wherein the at least one microsensor includes an antenna configured to receive and transmit signals, wherein the at least one microsensor is configured to release the at least one microsensor in response to receiving a signal from an external device.

8. The system of claim 1, wherein the receptacle comprises at least one inner shell, wherein the outer and inner shells are concentric.

9. The system of claim 1, wherein the receptacle comprises a siloxane.

10. The system of claim 1, further comprising a second receptacle encapsulating at least one second microsensor, the at least one second microsensor being configured to detect one or more conditions of the fluidic medium, wherein the at least one microsensor encapsulated within the receptacle and the at least one second microsensor encapsulated within the second receptacle are configured to detect different conditions of the fluidic medium.

11. The system of claim 1, wherein the one or more conditions of the fluidic medium include at least one of a chemical composition, a pressure, a flow path, a temperature, a storage volume, a composition, a depth, a fluid conductivity, a density, a viscosity, a thermal conductivity, a buoyancy, and a pH.

12. The system of claim 1, wherein the fluidic medium comprises one or more subterranean fluids.

13. The system of claim 1, wherein the fluidic medium comprises at least one of geothermal brine, crude oil, ground water and hazardous waste.

14. The system of claim 1, wherein the receptacle is configured to release the at least one microsensor after a predetermined period of time, the predetermined period of time being specified by a user.

15. The system of claim 1, wherein a plurality of microsensors are encapsulated within the receptacle, where at least two of the microsensors are configured to detect different conditions of the fluidic medium.

16. The system of claim 1, wherein the receptacle comprises a second shell disposed in the outer shell, wherein the microsensor is encapsulated within the second shell.

17. The system of claim 16, wherein the second shell is comprised of a different material than the outer shell.

18. The system of claim 16, wherein receptacle includes a tracer material disposed within the second shell.

19. The system of claim 18, wherein the at least one microsensor is configured to release the tracer material in at least a region of the receptacle located between the second shell and the outer shell.

20. The system of claim 16, wherein the receptacle includes a third shell disposed in the outer shell, wherein the third shell encapsulates at least one second microsensor, wherein the at least one microsensor encapsulated within the second shell and the at least one second microsensor encapsulated within the third shell are configured to detect different conditions of the fluidic medium.

21. A system, comprising:

at least one microsensor configured to detect one or more conditions of a fluidic medium of a reservoir; and a receptacle, wherein the receptacle encapsulates the at least one microsensor, wherein the receptacle comprises a first shell and a second shell, wherein the second shell is concentrically disposed in the first shell, wherein the at least one microsensor is disposed in a region between the first shell and the second shell.

22. The system of claim 21, further comprising a tracer material disposed in the second shell.

23. The system of claim 22, wherein the second shell is configured to release the tracer material when at least one of the one or more conditions of the fluidic medium is about equal to, less than or greater than a predetermined value.

24. The system of claim 22, wherein the second shell is configured to release the tracer material after a predetermined length of time.

25. The system of claim 21, wherein the at least one microsensor is configured to break the second shell.

26. A system, comprising:

at least one microsensor configured to detect one or more conditions of a fluidic medium of a reservoir; and a receptacle, wherein the receptacle encapsulates the at least one microsensor, wherein the receptacle comprises a first shell, a second shell and a third shell, wherein the second and third shells are disposed in the first shell, wherein a tracer material is disposed in at least one of the second and third shells.

27. The system of claim 26, wherein the at least one microsensor is disposed in a region between the first shell and at least one of the second and third shells.

28. The system of claim 26, wherein the receptacle is configured to dissolve when at least one of the one or more conditions of the fluidic medium is about equal to, less than or greater than a predetermined value.

29. The system of claim 26, wherein the receptacle is configured to release the at least one microsensor when at least one of the one or more conditions of the fluidic medium is about equal to, less than or greater than a predetermined value.

30. A method, comprising:

injecting the at least one microsensor of claim 1 into a fluidic medium of a reservoir, and detecting the one or more conditions of the fluidic medium of the reservoir via the at least one microsensor.

31. The method of claim 30, wherein the receptacle comprises porous material configure to facilitate contact between the fluidic medium and the at least one microsensor.

32. The method of claim 30, further comprising transmitting the one or more conditions of the fluidic medium of the reservoir.

33. The method of claim 30, further comprising analyzing the one or more conditions of the fluidic medium detected by the at least one microsensor.

34. The method of claim 30, wherein the one or more conditions of the fluidic medium is selected from a group consisting of: a temperature, a pressure, a chemical composition, a pH, a density, a thermal conductivity, an electrical conductivity, and a velocity.

35. The method of claim 30, further comprising releasing at least one microsensor from the receptacle when at least one of the one or more detected conditions is about equal to, less than or greater than a predetermined value.

* * * * *